US006018921A

United States Patent [19]

Lindsay

[11] Patent Number: 6,018,921

[45] Date of Patent: Feb. 1, 2000

[54] TRANSVERSE TRUSS FOR BUILDING STRUCTURE

[76] Inventor: Fredrick H. Lindsay, 9393-120th La., North, Seminole, Fla. 34642

[21] Appl. No.: 09/161,269

[22] Filed: Sep. 26, 1998

Related U.S. Application Data

[60] Provisional application No. 60/060,204, Sep. 27, 1997.

[51] Int. Cl.[7] ..... E04C 3/02

[52] U.S. Cl. ..... 52/690; 52/693; 52/143; 52/730.7; 52/731.1

[58] Field of Search ..... 52/690, 693, 650.1, 52/143, 730.7, 731.1, 735.1, 729.2

[56] References Cited

U.S. PATENT DOCUMENTS

| | | | |
|---|---|---|---|
| 3,229,440 | 1/1966 | Troutner | 52/693 |
| 3,571,993 | 3/1971 | Potter | 52/143 X |
| 3,716,267 | 2/1973 | Lindsay . | |
| 4,001,999 | 1/1977 | Chandler | 52/693 |
| 4,015,375 | 4/1977 | Lindsay . | |
| 4,019,299 | 4/1977 | Lindsay . | |
| 4,106,258 | 8/1978 | Lindsay . | |
| 4,283,890 | 8/1981 | Takeda et al. | 52/143 |
| 4,863,189 | 9/1989 | Lindsay . | |
| 4,930,809 | 6/1990 | Lindsay . | |
| 5,028,072 | 7/1991 | Lindsay . | |
| 5,201,546 | 4/1993 | Lindsay . | |
| 5,226,583 | 7/1993 | Imashimizu . | |
| 5,488,809 | 2/1996 | Lindsay . | |
| 5,579,622 | 12/1996 | DeVon et al. . | |
| 5,640,814 | 6/1997 | Godfrey | 52/143 |

FOREIGN PATENT DOCUMENTS

| | | | |
|---|---|---|---|
| 1011075 | 5/1977 | Canada | 52/693 |

*Primary Examiner*—Beth Aubrey
*Assistant Examiner*—Brian E. Glessner
*Attorney, Agent, or Firm*—Frijouf, Rust & Pyle, P.A.

[57] ABSTRACT

An improved transverse truss is disclosed for cooperating with a first and a second longitudinally extending beam of a building structure. The transverse trust comprises a lower transverse member. A first and a second truss portion is secured to a first and a second end of the lower transverse member. A first and a second upstanding member are secured to the lower transverse member adjacent to the first and second truss portions for defining a first and a second slot therebetween. The first and the second slots receive the first and the second longitudinally extending beam. An upper transverse member is secured to the first and second truss portions for entrapping the first and second longitudinally extending beams within the first and second slots.

14 Claims, 20 Drawing Sheets

TRANSVERSE TRUSS FOR BUILDING STRUCTURE

CROSS-REFERENCE TO RELATED APPLICATION

This application claims benefit of U.S. Patent Provisional application Ser. No. 60/060,204 filed Sep. 27, 1997. All subject matter set forth in provisional application Ser. No. 60/060,204 is hereby incorporated by reference into the present application as fully set forth herein.

BACKGROUND OF THE INVENTION

1. Field of the Invention

This invention relates to building structures and more particularly to an improved transverse truss for a building structure.

2. Background of the Invention

In recent years, the manufactured home industry has substantially increased the quality of materials and construction of manufactured homes. This increase in quality and construction has been the result of superior materials, superior construction techniques, and new innovations which have resulted in a substantial increase in performance with a reduction in cost.

In general, a manufactured home is erected in an automated manufacturing factory using modern patterns, assembly line, and modern assembly equipment. The use of these automation techniques substantially reduces the cost and the time of construction of the manufactured home. After the manufactured home is completed, the manufactured home is stored on supports to await transportation to a permanent site for the manufactured home.

The manufactured home is loaded on a transportation carrier for transportation to the permanent site for the manufactured home. The manufactured home is positioned onto the transportation carrier by crane or other lifting means. The transportation carrier comprises a steel frame assembly supported by plural axles and transport wheels. The transportation carrier includes a hitch for attaching the transportation carrier to a towing vehicle such as a truck for transporting the manufactured home to the permanent site.

After the manufactured home is towed to the permanent site, the manufactured home is removed from the transportation carrier by a crane or other lifting means and the manufactured home is positioned on a foundation at the permanent home site. After removal of the manufactured home, the carrier transport is towed back to the manufacturing factory by a towing vehicle such as a truck for use in delivering another manufactured home. Unfortunately, the carrier transport is returned to the manufacturing factory without a load thereby substantially increasing the overall cost of delivery of the manufactured home. It is estimated that the cost of returning the carrier transport to the manufacturing factory is approximately one dollar per mile. Furthermore, the task of moving the manufactured home from the carrier transport to the foundation at the permanent home site requires the use of a crane or other lifting means. Accordingly, the transportation and installation of manufactured homes requiring the use of a carrier transport substantially adds to the overall cost of the manufactured home.

Among the most significant construction innovations developed in the manufactured home industry is the use of a dual purpose flooring system for a manufactured home. The dual purpose flooring system for a manufactured home comprises plural longitudinally extending beams and a multiplicity of transverse cross beams. The plural longitudinally extending beams are preferably steel I-beams with the multiplicity of transverse cross beams comprising wooden trusses.

The dual purpose flooring system provides a first function for the manufactured home by providing a removable transport wheel assembly and a removable hitch assembly for transporting the manufactured home to the permanent home site. A removable transport wheel assembly and a removable hitch assembly are secured to the plural longitudinally extending teams for transporting the manufactured home and eliminating the need for an independent transportation carrier. When the manufactured home reaches the permanent home site, the removable transport wheel assembly and a removable hitch assembly are removed from the manufactured home and are shipped to the manufacturing factory. Only the removable transport wheel assembly and a removable hitch assembly which comprise the most expensive portions of a transport carrier need to be returned to the manufacturing factory. In addition, the removable transport wheel assembly and a removable hitch may be returned to the manufacturing factory by a conventional freight carrier thus eliminating the need for using the towing vehicle as was the problem in the prior art manufactured home carrier transports.

The dual purpose flooring system provides a third function for the manufactured home by reducing the overall height of the manufactured home when the manufactured home is being transported to the permanent home site. Since the removable transport wheel assembly and the removable hitch assembly are directly secured to the plural longitudinally extending beams of the manufactured home, the dual purpose flooring system reduces the overall height of the manufactured home during transportation by the thickness of the frame of the carrier transport of the prior art.

The dual purpose flooring system provides a second function for the manufactured home by providing a rigid floor for supporting the manufactured home at the permanent home site. The plural longitudinally extending beams remain with the manufactured home after removal of the removable transport wheel assembly and the removable hitch assembly to provide a rigid support to the permanently mounted manufactured home. The plural longitudinally extending beams remain with the manufactured home to add to the structural integrity and strength of the flooring system. Several examples of the aforementioned dual purpose flooring system are disclosed in the following U.S. Letters Patent of the present inventor.

U.S. Pat. No. 4,019,299 to Lindsay discloses an improved floor assembly being incorporated into a mobile building. A pair of identical frame assemblies form the floor of the building each including a plurality of middle beams mounted to and atop lower beams and further including a pair of adjacent interior sidewalls attached to the middle beams and extending therebeneath being adjacent the lower beams. The exterior sidewalls are mounted to the frame assemblies. Wheeled carriages are removably mountable to the assemblies facilitating transportation of the assemblies to a building site. A skirt is permanently mounted externally to the sidewalls and extends adjacent the floor assembly. A bracket is connected to the middle beam and the bottom beam of each frame assembly and in addition is connected to a pole which supports the adjacent middle portions of the frame assemblies. The interior sidewalls are slidably received in the bracket. In an alternate embodiment, the floor frame assembly is incorporated into a floor joist.

U.S. Pat. No. 4,863,189 to Lindsay discloses a floor frame assembly, formed principally of wood material, having two load-bearing outer beams and front and rear end members defining a periphery and a plurality of transverse load-supporting trusses connected normal to the outer beam between the end members. In a preferred embodiment, each truss has an upper elongate member, a shorter central elongate member attached parallel thereto by vertical cross-braced elements, and on either side of the central member a braced vertical member spaced therefrom to provide gaps of predetermined height and width. Each truss also has an end portion of the upper elongate member in cantilever form for contact thereat with a load-supporting surface at the permanent location of the floor assembly, so that additional external beams or continuous wall surfaces to support the completed floor frame assembly and any superstructure thereon is rendered unnecessary. The floor frame assembly may be further supported by conventional piers or jackposts at points under two elongate, load-supporting, inner beams closely received and connected to the trusses within the gaps. These inner beams may optionally be made of wood material, wood material supported along the edges at selected portions by metal reinforcement, or entirely formed of I-section beam lengths. In one aspect of the invention, at least one of the load-supporting outer beams has a larger vertical dimension than the other outer beam and two floor frame assemblies thus formed may be united at their respective wider outer beams and provide additional support thereunder to generate a commensurately larger floor frame assembly structure.

U.S. Pat. No. 5,028,072 to Lindsay discloses a unified floor frame assembly having two elongate outer load supporting beams formed of elongate beam sections that are butt-spliced to be cambered in parallel vertical planes to counter forces that may tend to cause sagging of the floor frame assembly during transportation. At inner vertical perimeter surfaces of the elongate beams are provided attachment plates for attachment, first, of a wheel carrier assembly detachably mountable thereto with a plurality of wheels partially recessed within the floor frame assembly and, second, a towing hitch assembly attachable to a forward end of the floor frame assembly for applying a towing force thereat. A moisture, dirt, insect and pest excluding thin covering is provided underneath the floor frame assembly and sections of heating and ventilating ducting, piping, wiring and the like are included during manufacture of the floor frame assembly. Individual floor frame assemblies may be supported at their permanent location underneath the periphery or, where two such floor frame assemblies are to be coupled to obtain a larger size floor, central elongate beams may be supported by metal posts. Upon delivery of the floor frame assembly to its intended location, the wheel carrier assembly and the towing hitch assembly are both detached and removed therefrom for reuse.

U.S. Pat. No. 5,201,546 to Lindsay discloses a towable unified floor frame assembly deriving lengthwise strength from two elongate I-beams disposed symmetrically about a longitudinal axis. The I-beams are separated by a plurality of angle-sectioned metal cross members welded therebetween. A plurality of trusses, corresponding in number and location to the metal cross members, is disposed to support an outer perimeter and a floor thereabove. Each truss incorporates upwardly inclined bracing elements located outwardly of the I-beams connected to flat metal connecting elements individually unified to the I-beams, preferably by welding. A waterproof and dirt excluding cover entirely covers the underneath of the floor frame assembly. Heating and ventilating ducts, power and telephone wires, water and waste pipes, thermal insulation and the like, are installed within the floor frame assembly. The entire floor frame assembly, and any superstructure built thereon, may be readily towed to a selected location on a plurality of wheels detachably mounted to brackets provided underneath the I-beams, a towing force being applied by a forwardly disposed detachable towing hitch.

U.S. Pat. No. 5,488,809 to Lindsay discloses a lightweight, strong, safely transportable modular unified floor assembly including a lengthwise wooden girder beam formed with male and female ends to facilitate cooperative integration thereby to another similar floor assembly. In another aspect of the invention, the floor assembly is manufactured with a stairwell opening of selected size and at a selected location. The floor assembly even with a stairwell opening according to this invention is strong enough to be transported comfortably and safely from its point of manufacture to the site at which it is to be located for use.

In some instances, the manufacturing factory of the manufactured home was located in close proximity to the ultimate permanent site of the manufactured home. In these instances, it is not necessary to use longitudinally extending steel I-beams since it is more economical to use wooded longitudinally extending beams and to deliver the manufactured home on a conventional transportation carrier. The use of a conventional transportation carrier to deliver the manufactured home is significantly less expensive than incorporating longitudinally extending steel I-beams into the frame structure of the manufactured home.

In still other instances, it would be desirable to have a beam assembly capable of being built on-site for a building structure that could function either as a roof beam or a floor beam.

Therefore, it is an object of this invention to provide an improved transverse truss for a building structure which may be incorporated into a manufactured home assembled or may be incorporated into a site-built building structured.

Another object of this invention is to provide an improved transverse truss for a building structure which can accommodate either steel longitudinally extending I-beams or which can accommodate wooden longitudinally extending beams.

Another object of this invention is to provide an improved transverse truss for a building structure which can accommodate plural longitudinally extending steel I-beams for transporting the manufactured home to the ultimate permanent site without the use of a conventional transportation carrier.

Another object of this invention is to provide an improved transverse truss for a building structure which can accommodate plural wooden beams for transporting the manufactured home to the ultimate permanent site with a conventional transportation carrier.

Another object of this invention is to provide an improved transverse truss for a building structure incorporating a void for receiving and accommodating a utility service device such as an air, electrical or plumbing conduits and the like.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention and the detailed description describing the preferred embodiment of the invention.

SUMMARY OF THE INVENTION

A specific embodiment of the present invention is shown in the attached drawings. For the purpose of summarizing the invention, the invention relates to an improved transverse truss for a building structure. The transverse truss cooperates with a first and a second longitudinally extending beam of the building structure. The transverse truss comprises a lower transverse member extending between a first and a second end. A first and a second truss portion is secured to the first and second ends of the lower transverse member. A first and a second upstanding member is secured to the lower transverse member adjacent to the first and second truss portions for defining a first and a second slot therebetween. The first and the second slots receive the first and the second longitudinally extending beam. An upper transverse member extends between a first and a second end. The first and second ends of the upper transverse member are secured to the first and second truss portions for entrapping the first and second longitudinally extending beams within the first and second slots.

The lower transverse member extends in a substantially horizontal direction and is disposed below the first and second longitudinally extending beams of the building structure. In one embodiment of the invention, the first and second longitudinally extending beams of the building structure are wooded beams having a substantially rectangular cross-section. In another embodiment of the invention, the first and second longitudinally extending beams of the building structure are steel I-beams.

In a more specific embodiment of the invention, each of the first and second truss portions comprises an outer and inner support extending substantially perpendicularly to the lower interconnect transverse member with an upper truss element interconnecting the inner and outer supports. A brace extends angularly between the inner and outer supports.

In one specific example of the invention, the brace extends angularly from an intersection between the lower transverse member and the outer upright member to an intersection between the upper truss element and the inner upright support. In another specific example of the invention, the brace extending angularly from an intersection between the upper transverse member and the outer upright member to an intersection between the lower truss element and the inner upright support.

Preferably, each of the upstanding members extends perpendicularly from the lower transverse member a distance commensurate with a distance the first and second truss portions extend from the lower transverse member. The first and second upstanding members define a void between the first and second upstanding members for receiving a service device such as electrical, plumbing or air conditioning service. In a specific embodiment of the invention, a first and a second bracket secure the first and second longitudinally extending beams to the transverse truss in proximity to the first and second slots.

The foregoing has outlined rather broadly the more pertinent and important features of the present invention in order that the detailed description that follows may be better understood so that the present contribution to the art can be more fully appreciated. Additional features of the invention will be described hereinafter which form the subject matter of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
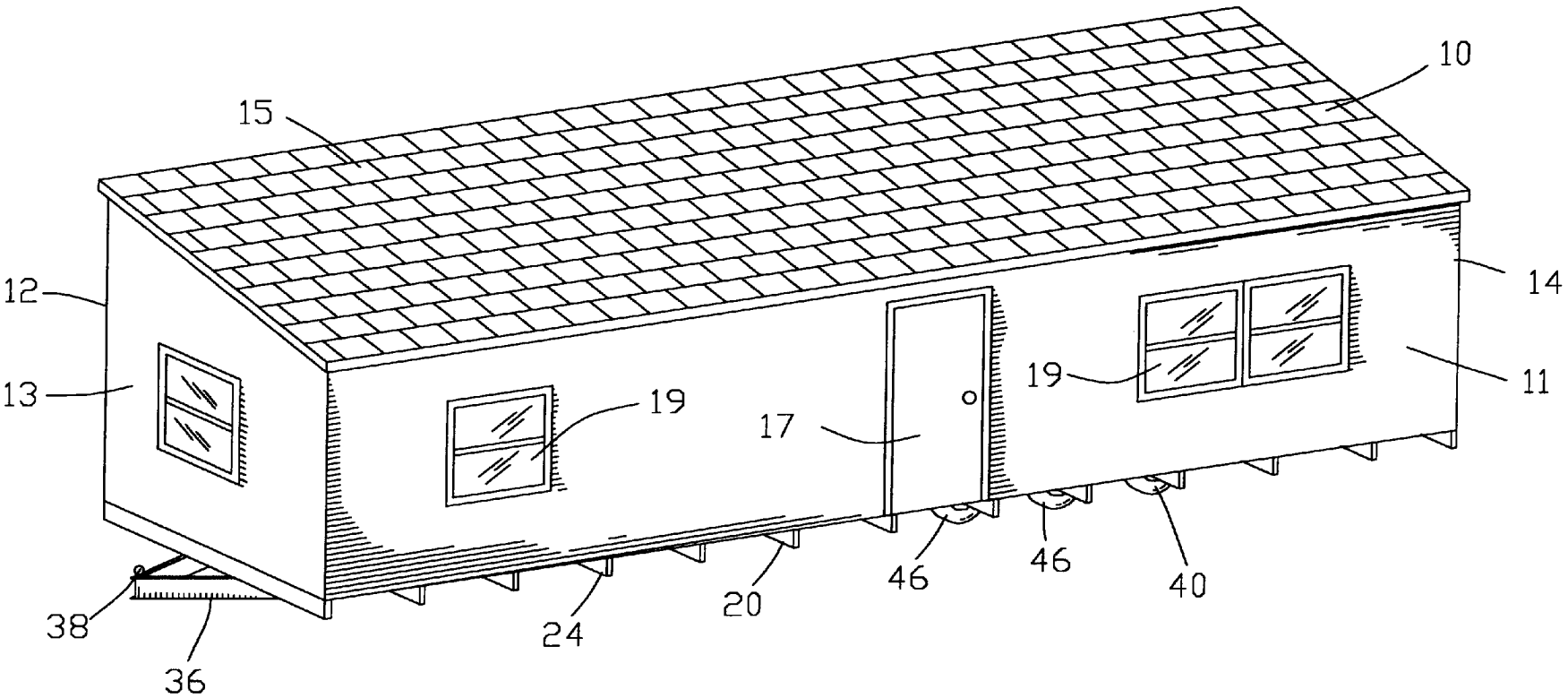
FIG. 1 is an isometric view of a building structure shown as a manufactured home incorporating a first embodiment of the transverse truss of the present invention disposed on a carrier transport for transporting the manufactured home to a permanent site.
Figure 2:
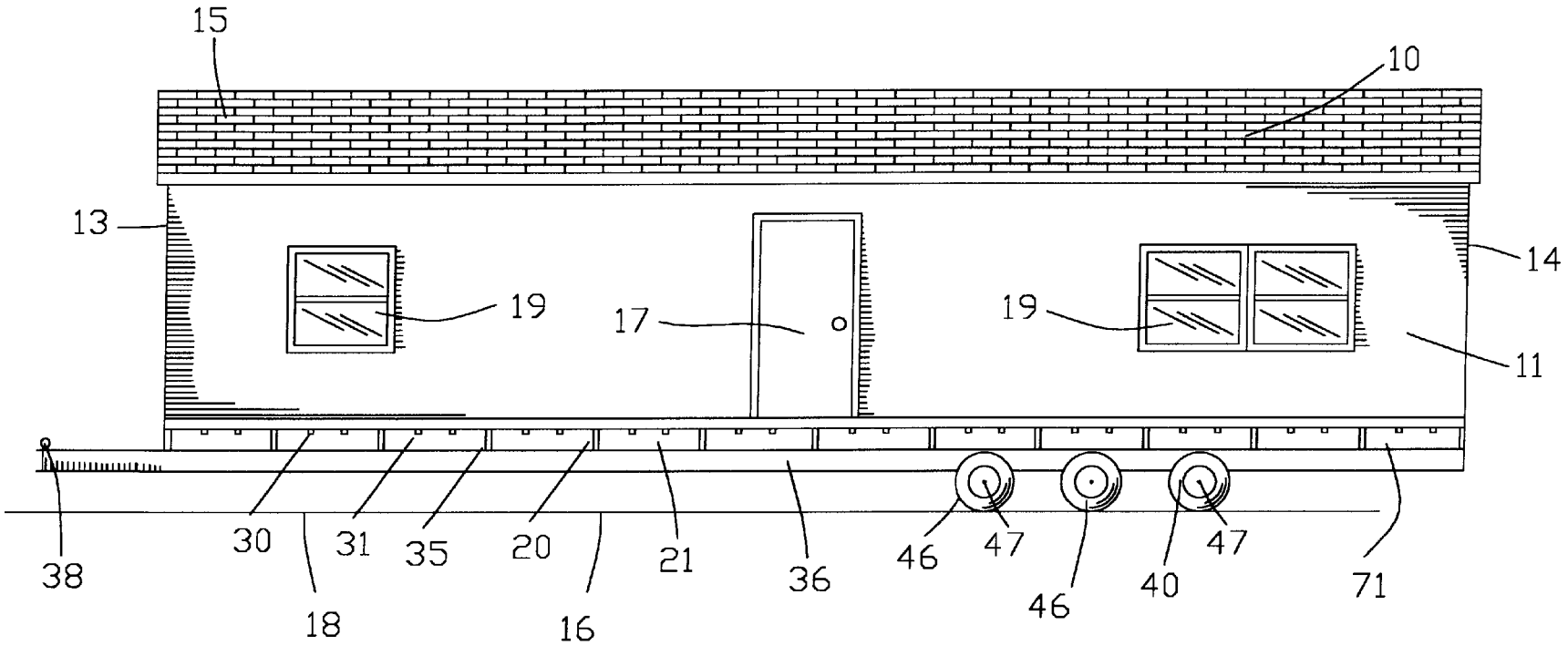
FIG. 2 is a side elevational view of FIG. 1.
Figure 3:
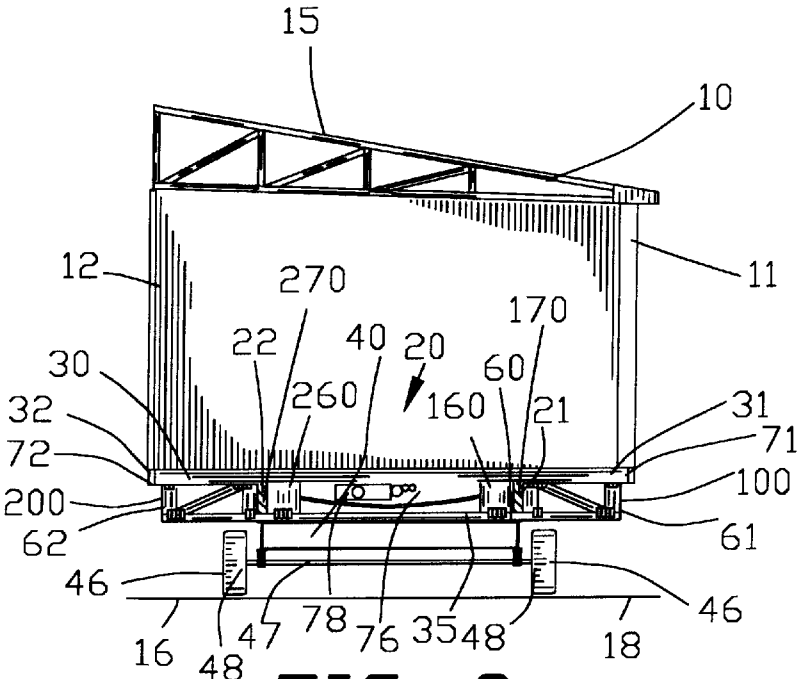
FIG. 3 is an end view of FIG. 2 illustrating the manufactured home disposed on the carrier transport.

FIGS. 1–3 are isometric, side and end views of a building structure 10 shown as a manufactured home incorporating a first embodiment of the present invention. The manufactured home 10 comprising peripheral walls 11 and 12, end walls 13 and 14 and a roof 15. The manufactured home 10 includes a door 17 and a plurality of windows 19. The manufactured home 10 is designed to be transported to a remote location and to be erected on a ground surface 16 at a building site 18.

The manufactured home 10 has a frame 20 comprising a first and a second frame element shown as a first and a second longitudinally extending beam 21 and 22. A plurality of upper transverse members shown as floor beams 30 extend in a spaced apart parallel relationship to the first and second longitudinally extending beams 21 and 22. Each of the plurality of floor beams 30 extends between a first and a second end 31 and 32.

A plurality of transverse trusses 35 of the present invention extend perpendicularly to the first and second longitudinally extending beams 21 and 22 and cooperate with selected ones of the plurality of floor beams 30. As will be described in greater detail hereinafter, the plurality of transverse trusses 35 add significantly to the overall strength of the manufactured home 10.

After the manufactured home 10 is completed at a manufacturing facility, the manufactured home 10 is placed on a carrier transport 36 and is towed by a towing vehicle such as a truck (not shown) to the building site 18. The manufactured home 10 is shown as one-half of a two-part unit commonly referred to as a double wide manufactured home 10. In the case of a double wide manufactured home 10, the peripheral wall 12 is only a partial wall enabling the manufactured home 10 to be joined with a mirror image of FIG. 3 at the peripheral wall 12 for creating a single double wide unit. The structure and erection of the double wide unit of a manufactured home 10 should be well known to those skilled in the art.

As best shown in FIG. 3, the manufactured home 10 is shown disposed on the carrier transport 36 having a hitch 38. The carrier transport 36 includes a plurality of wheel assemblies 40 with each of the plurality of wheel assemblies 40 having plural wheels 46 journalled on an axle 47. Each of the plurality of wheel assemblies 40 is secured to the frame elements 21 and 22 by springs 48.

Upon reaching the building site 18, the manufactured home 10 is removed from the carrier transport 36 and is permanently mounted at the building site 18. Typically, the manufactured home 10 is lifted or rolled from the carrier transport 36 onto the foundation pilings 51 and 52. The lifting of the manufactured home 10 onto the foundation pilings 51 and 52 requires the use of a lifting crane. The rolling of the manufactured home 10 from the carrier transport 36 onto the foundation pilings 51 and 52 requires the use of rolling equipment. Thereafter, the carrier transport 36 is returned to the manufacturing facility for transporting another manufactured home to another building site.

Figure 4:
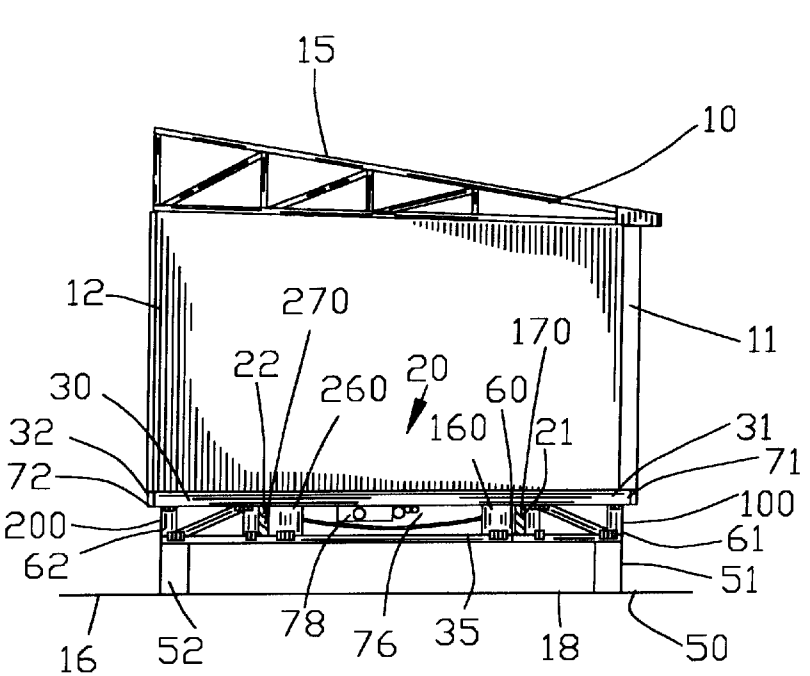
FIG. 4 is an end view of the manufactured home of FIG. 3 which has been removed from the carrier transport of FIG. 3 and placed upon a stem wall foundation.

FIG. 4 is an end view similar to FIG. 3 after the manufactured home 10 has been lifted from the carrier transport 36 and placed upon a foundation 50 comprising foundation pilings 51 and 52 on the ground surface 18. The manufactured home 10 is secured to the foundation pilings 51 and 52 by conventional means which should be well known to those skilled in the art.

The foundation pilings 51 and 52 extend upwardly from the ground surface 16 to space the manufactured home 10 from the ground surface 16. The foundation pilings 51 and 52 are commonly referred to as stem walls. The distance of the stem walls required to space the manufactured home 10 from the ground surface 16 is regulated by local or federal building codes or regulations.

The frame 20 of the manufactured home 10 includes the first and second longitudinally extending beams 21 and 22 and the plurality of transverse floor beams 30. The first and second longitudinally extending beams 21 and 22 are shown as wooden beams having a substantially rectangular cross-section. However, the first and second longitudinally extending beams 21 and 22 may be formed from other materials and shapes as will be apparent hereinafter.

The plurality of transverse floor beams 30 are disposed upon the first arid second longitudinally extending beams 21 and 22. The plurality of transverse floor beams 30 support a floor or a roof structure as should be apparent to those skilled in the art.

The plurality of transverse trusses 35 extend perpendicularly to the first and second longitudinally extending beams 21 and 22. The plurality of transverse trusses 35 cooperate with selected ones of the plurality of floor beams 30 to add mechanical strength of the manufactured home 10. Each of the transverse trusses 35 comprises a lower transverse member 60 extending between a first end 61 and a second end 62. Preferably, the lower transverse member 60 is fashioned from wood. Each of the improved transverse trusses 35 comprises a first truss portion 100 and a second truss portion 200. The first and second truss portions 100 and 200 are respectively secured to the first and second ends 61 and 62 of the lower transverse member 60. The first and second truss portions 100 and 200 are mirror images of one another.

The improved transverse trusses 35 comprises a first and a second upstanding member 160 and 260 secured to the lower transverse member 60 adjacent to the first and second truss portions 100 and 200 for defining a first and a second slot 170 and 270 therebetween.

The first and second longitudinally extending beams 21 and 22 are received within the first and second slots 170 and 270. The first and second longitudinally extending beams 21 and 22 engage with the lower transverse member 60 and the first and second truss portions 100 and 200, respectively.

The first and second ends 31 and 32 of the floor beam 30 are respectively secured to the first and second truss portions 100 and 200. The first and second longitudinally extending beams 21 and 22 are enclosed within the first and second slots 170 and 270 by the floor beam 30. Preferably, a first and a second peripheral beam 71 and 72 are secured to the first and second ends 31 and 32 of the floor beam 30.

A void 76 is defined between the first and second upstanding members 160 and 260. The void 76 receives a service device 78 such as an air conduits, electrical wires and conduits and plumbing pipes and the like. As will be described in greater detail hereinafter, the void 76 is an open top void 76 for facilitating the introduction of the service device 78 prior to securing the first and second ends 31 and 32 of the floor beam 30 to the first and second truss portions 100 and 200.

Figure 5:
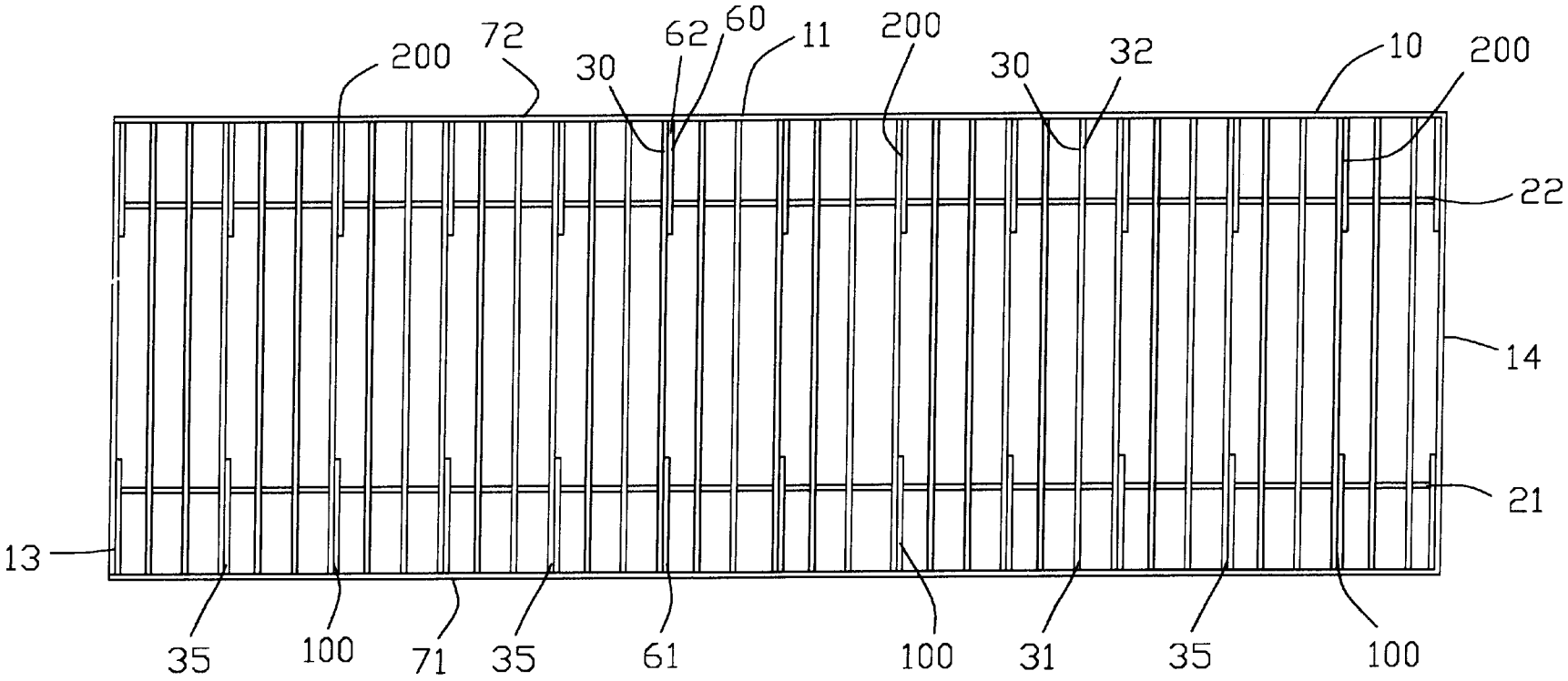
FIG. 5 is a top view of the frame of the manufactured home incorporating the first embodiment of the transverse truss of the present invention.

FIG. 5 is a top view of the frame 20 of the manufactured home 10 incorporating the first embodiment of the plurality of transverse truss 35 of the present invention. The manufactured home 10 includes the plurality of the transverse truss 35 cooperating with selected ones of the plurality of floor beams 30. Each of the plurality of floor beams 30 extends between a first and a second end 31 and 32. The plurality of the transverse truss 35 provide additional support for the floor or the roof structure. In this embodiment of the invention, the plurality of transverse truss 35 cooperate with every third floor beams 30. However, it should be appreciated by those skilled in the art that the spacing of the plurality of transverse trusses 35 may be varied in accordance with the desired load requirement of the floor or roof structure.

Figure 6:
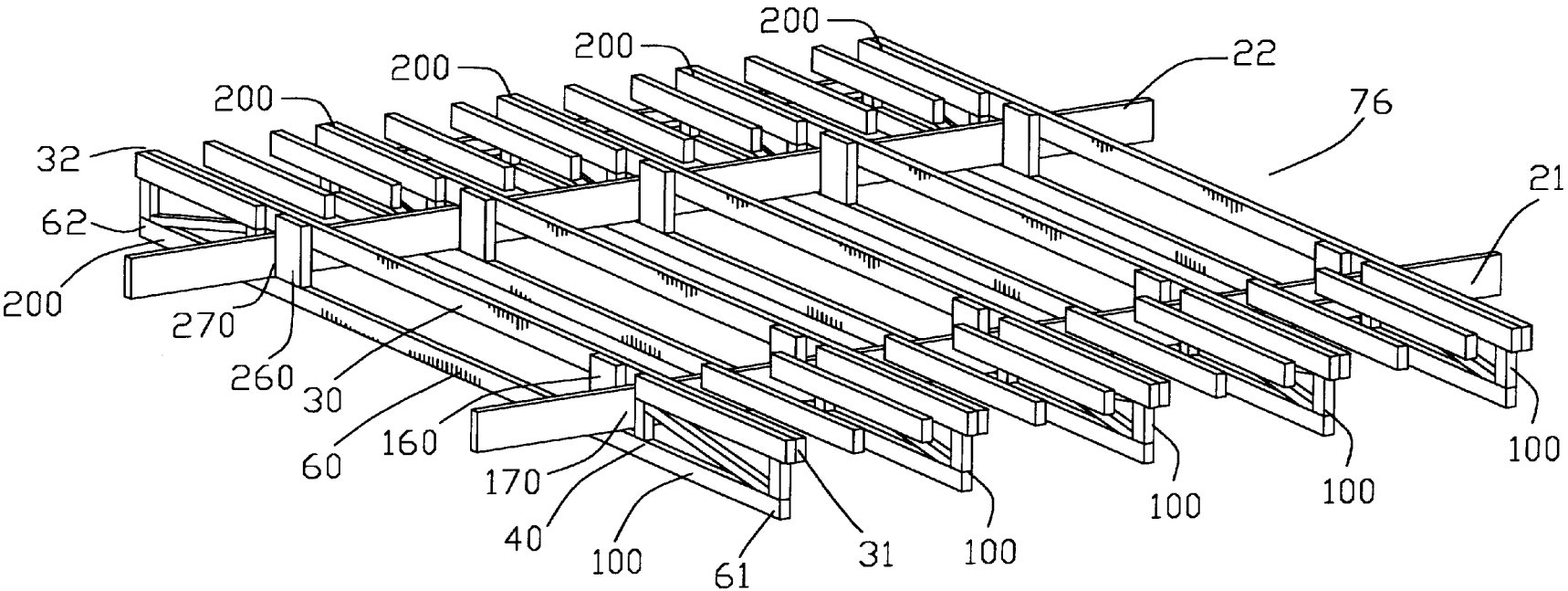
FIG. 6 is an enlarged isometric view of a forward portion of the frame of the manufactured home of FIG. 5.

FIG. 6 is an enlarged isometric view of a forward portion of the frame 20. In this example of the invention, the plurality of floor beams 30 are shown as wood beams. The plurality of floor beams 30 arranged in a substantially parallel relationship and are supported by the first and second longitudinally extending beams 21 and 22. Each of the improved transverse truss 35 comprises the first truss portion 100 and second truss portions 200.

Figure 7:
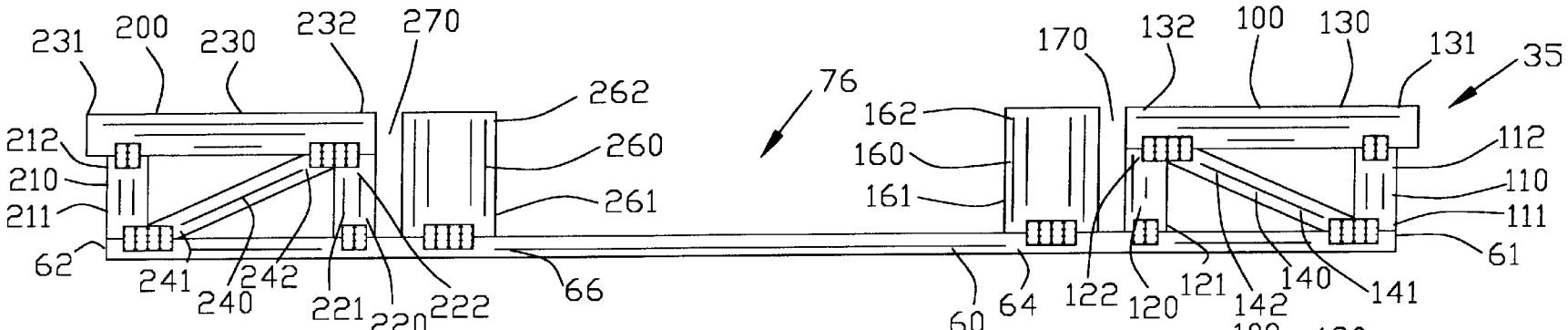
FIG. 7 is an enlarged view of a portion of FIG. 4 illustrating the first embodiment of the transverse truss of the present invention.

FIG. 7 is an enlarged front view of the transverse truss 36 of FIGS. 3–6. The transverse truss 35 comprises a lower transverse member 60 extending between the first end 61 and the second end 62. Preferably, the lower transverse member 60 is fashioned from wood. The first and second truss portions 100 and 200 are respectively secured to the first and second ends 61 and 62 of the lower transverse member 60.

The first truss portion 100 comprises an outer support 110 having a first and a second end 111 and 112. The first end 111 of the outer support 110 is secured in proximity to the first end 61 of the lower transverse member 60. The second end 112 of the outer support 110 extends upwardly from the lower transverse member 60. The outer support 110 extends substantially perpendicular to the lower transverse member 60. Preferably, the outer support 110 is fashioned from wood.

An inner support 120 extends between a first and a second end 121 and 122. The first end 121 of the inner support 120 is secured in proximity to an interior region 64 of the lower transverse member 60. The second end 122 of the inner support 120 extends upwardly from the lower transverse member 60. The inner support 120 extends substantially perpendicular to the lower transverse member 60. Preferably, the inner support 120 is fashioned from wood.

An upper truss element 130 extends between a first and a second end 131 and 132. The first end 131 of the upper truss element 130 is connected to the second end 112 of the outer support 110 whereas the second end 132 of the upper truss element 130 is connected to the second end 122 of the inner support 120. Preferably, the upper truss element 130 is fashioned from wood.

A brace 140 extends between a first end 141 and a second end 142. The brace 140 is angularly disposed between the outer support 110 and the inner support 120. In this embodiment of the invention, the first end 141 of the brace 140 is secured to the intersection of the lower transverse member 60 with the first end 111 of the outer support 120. The second end 142 of the brace 140 is secured to the intersection of the upper truss element 130 with the second end 122 of the inner support 110. Preferably, the brace 140 is fashioned from wood.

The outer support 110 and the inner support 120 are secured to the lower transverse member 60 by mechanical fasteners such as gang nails, metal plates and metal fasteners or the like. The outer support 110 and the inner support 120 are secured to the upper truss element 130 by mechanical fasteners such as gang nails, metal plates and metal fasteners or the like. Similarly the brace 140 is secured by mechanical fasteners such as gang nails, metal plates and metal fasteners or the like.

The second truss portion 200 comprises an outer support 210 having a first and a second end 211 and 212. The first end 211 of the outer support 210 is secured in proximity to the second end 62 of the lower transverse member 60. The second end 212 of the outer support 210 extends upwardly from the lower transverse member 60. The outer support 210 extends substantially perpendicular to the lower transverse member 60. Preferably, the outer support 210 is fashioned from wood.

An inner support 220 extends between a first and a second end 221 and 222. The first end 221 of the inner support 220 is secured in proximity to an interior region 66 of the lower transverse member 60. The second end 222 of the inner support 220 extends upwardly from the lower transverse member 60. The inner support 220 extends substantially perpendicular to the lower transverse member 60. Preferably, the inner support 220 is fashioned from wood.

An upper truss element 230 extends between a first and a second end 231 and 232. The first end 231 of the upper truss element 230 is connected to the second end 212 of the outer support 210 whereas the second end 232 of the upper truss element 230 is connected to the second end 222 of the inner support 220. Preferably, the upper truss element 230 is fashioned from wood.

A brace 240 extends between a first end 241 and a second end 242. The brace 240 is angularly disposed between the outer support 210 and the inner support 220. In this embodiment of the invention, the first end 241 of the brace 240 is secured to the intersection of the lower transverse member 60 with the first end 211 of the outer support 210. The second end 242 of the brace 240 is secured to the intersection of the upper truss element 230 with the second end 222 of the inner support 220. Preferably, the brace 240 is fashioned from wood.

The outer support 210 and the inner support 220 are secured to the lower transverse member 60 by mechanical fasteners such as gang nails, metal plates and metal fasteners or the like. The outer support 210 and the inner support 220 are secured to the upper truss element 230 by mechanical fasteners such as gang nails, metal plates and metal fasteners or the like. Similarly the brace 240 is secured by mechanical fasteners such as gang nails, metal plates and metal fasteners or the like.

Each of the improved transverse truss 35 comprises a first upstanding member 160 and a second upstanding member 260. The first upstanding member 160 extends between a first and a second end 161 and 162. The first end 161 of the first upstanding member 160 is secured to the lower transverse member 60 adjacent to the first truss portion 100 for defining a first slot 170 therebetween. The first upstanding member 160 extends perpendicularly from the lower transverse member 60 a distance commensurate with a distance the first truss portion 100 extends from the lower transverse member 60.

The second upstanding member 260 extends between a first and a second end 261 and 162. The first end 261 of the second upstanding member 260 is secured to the lower transverse member 60 adjacent to the second truss portion 200 for defining a second slot 270 therebetween. The second upstanding member 260 extends perpendicularly from the lower transverse member 60 a distance commensurate with a distance the second truss portion 200 extends from the lower transverse member 60.

The void 76 is defined between the first and second upstanding members 160 and 260. The void 76 receives a service device 78 such as an air conduits, electrical wires and conduits and plumbing pipes and the like. The void 76 shown in FIGS. 7 and 8 is an open top void 76 for facilitating the introduction of the service device 78 with the void 76.

Figure 8:
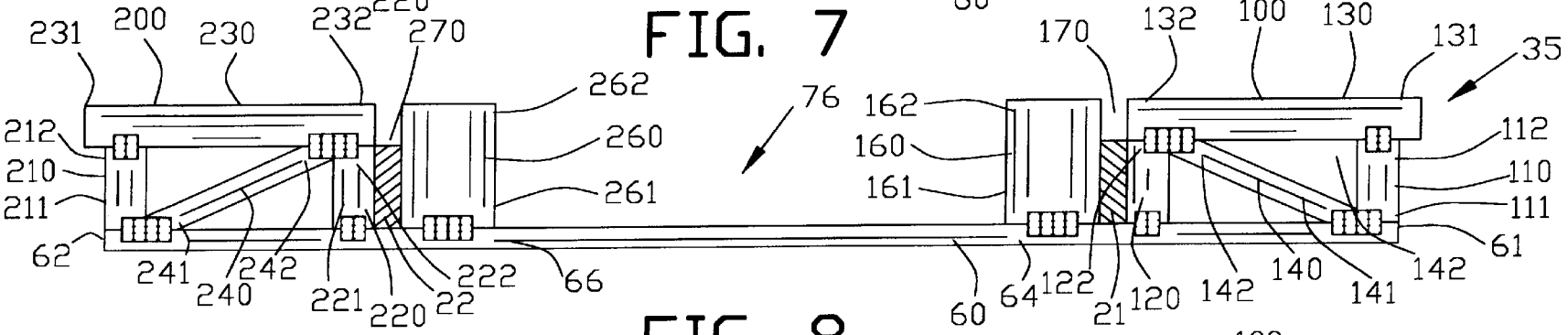
FIG. 8 is a view similar to FIG. 7 illustrating the first embodiment of the transverse truss receiving a first and a second longitudinally extending beam.

FIG. 8 illustrates the first and second longitudinally extending beams 21 and 22 being received within the first and second slots 170 and 270. The first longitudinally extending beam 21 engages with the lower transverse member 60, the inner support 110 and the upstanding member 160. Similarly, the second longitudinally extending beam 22 engages with the lower transverse member 60, the inner support 210 and the upstanding member 260.

Figure 9:
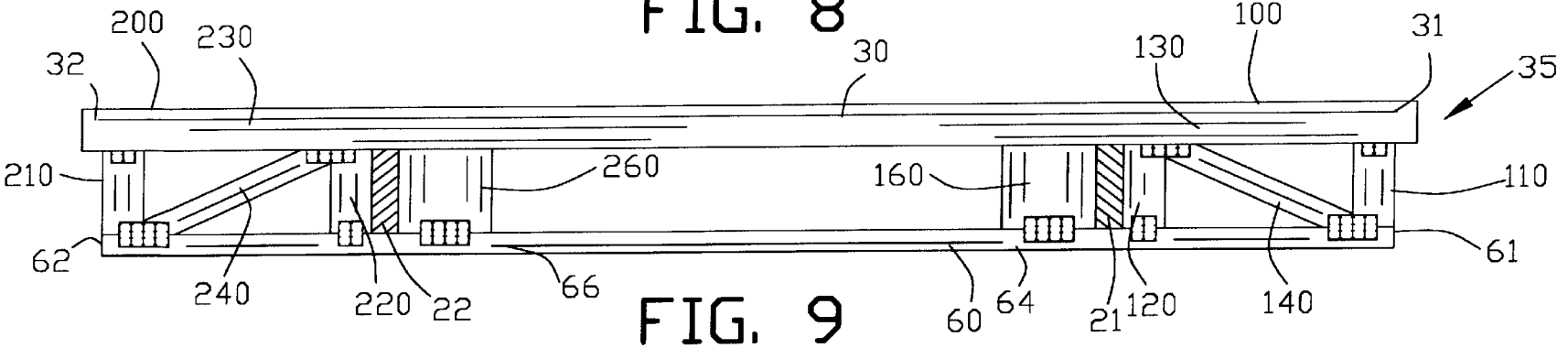
FIG. 9 is a view similar to FIG. 8 illustrating the securing of the first and second longitudinally extending beams within the transverse truss.
Figure 11:
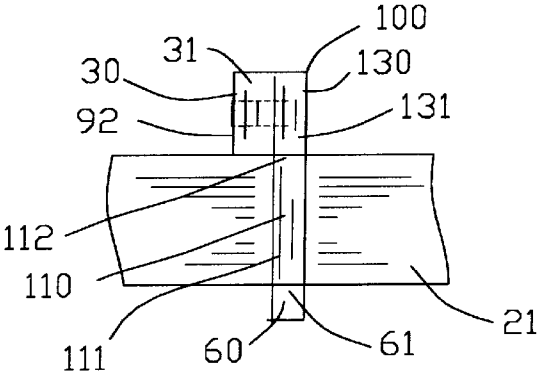
FIG. 11 is a right side view of FIG. 10.
Figure 10:
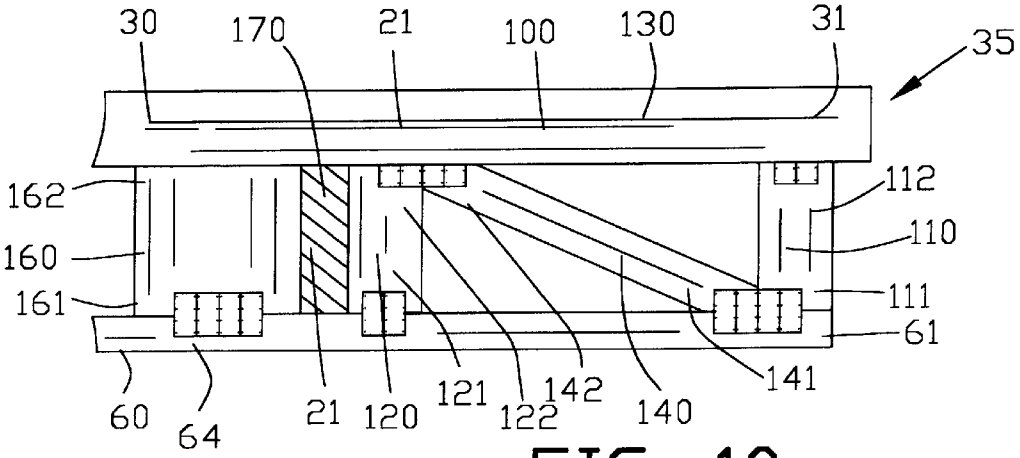
FIG. 10 is a magnified view of a portion of FIG. 9.
Figure 13:
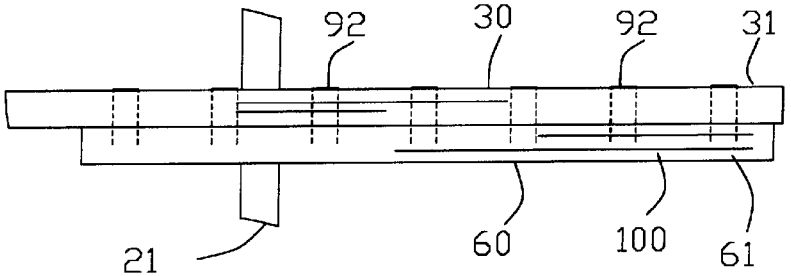
FIG. 13 is a bottom view of FIG. 10.

FIG. 9 is a view similar to FIG. 8 illustrating the first and second ends 31 and 32 of the floor beam 30 being secured to the first and second truss portions 100 and 200. In addition, the floor beam 30 is secured to the first and second upstanding members 160 and 260. The floor beam 50 is secured by mechanical fasteners such as gang nails, metal plates and metal fasteners or the like.

Figure 12:
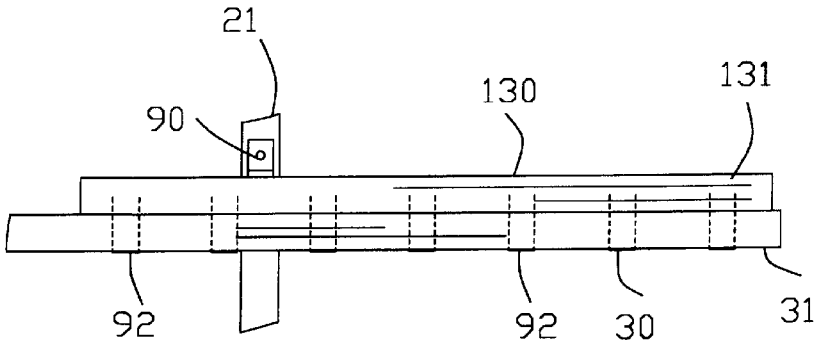
FIG. 12 is a top view of FIG. 10.

FIGS. 10–13 are various magnified views of a portion of FIG. 9. The floor beam 30 entraps the first and second longitudinally extending beams 21 and 22 within the first and second slots 170 and 270 of the transverse truss 10. As best shown in FIG. 12, a conventional brackets 90 may be provided for securing the first and second longitudinally extending beams 21 and 22 to the transverse truss 35 in proximity to the first and second slots 170 and 270. Preferably, the first and second ends 31 and 32 of the floor beam 30 are secured to the first and second truss portions 100 and 200 by suitable means such as an adhesive, mechanical fasteners such as nails or staples 92 or a combination of both. The first and second ends 31 and 32 of the floor beam 30 may be secured to the first and second truss portions 100 and 200 by an adhesive with staples 92 holding the floor beam 30 during the curing of the adhesive.

Figure 14:
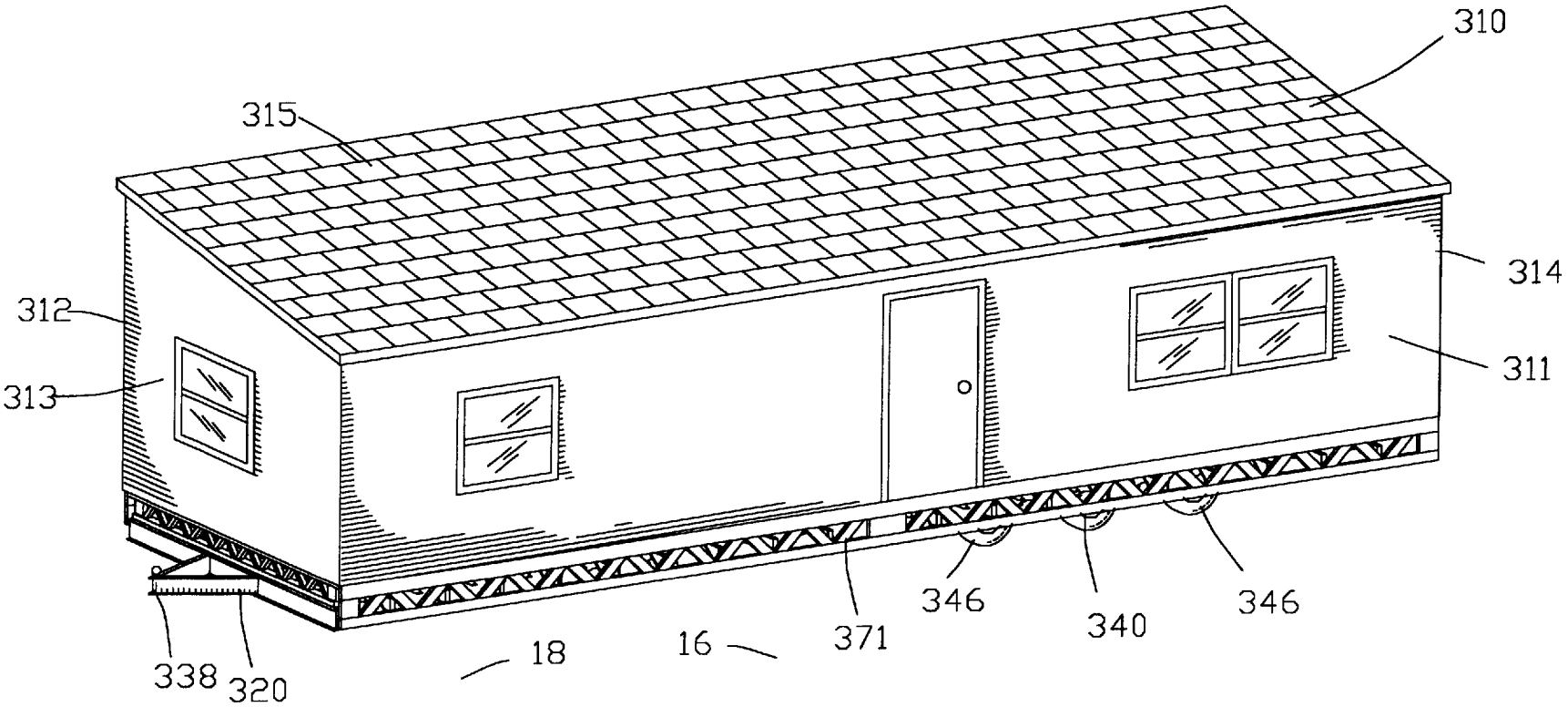
FIG. 14 is an isometric view of a building structure shown as a manufactured home incorporating a second embodiment of the transverse truss of the present invention for transporting the manufactured home to a permanent site.
Figure 15:
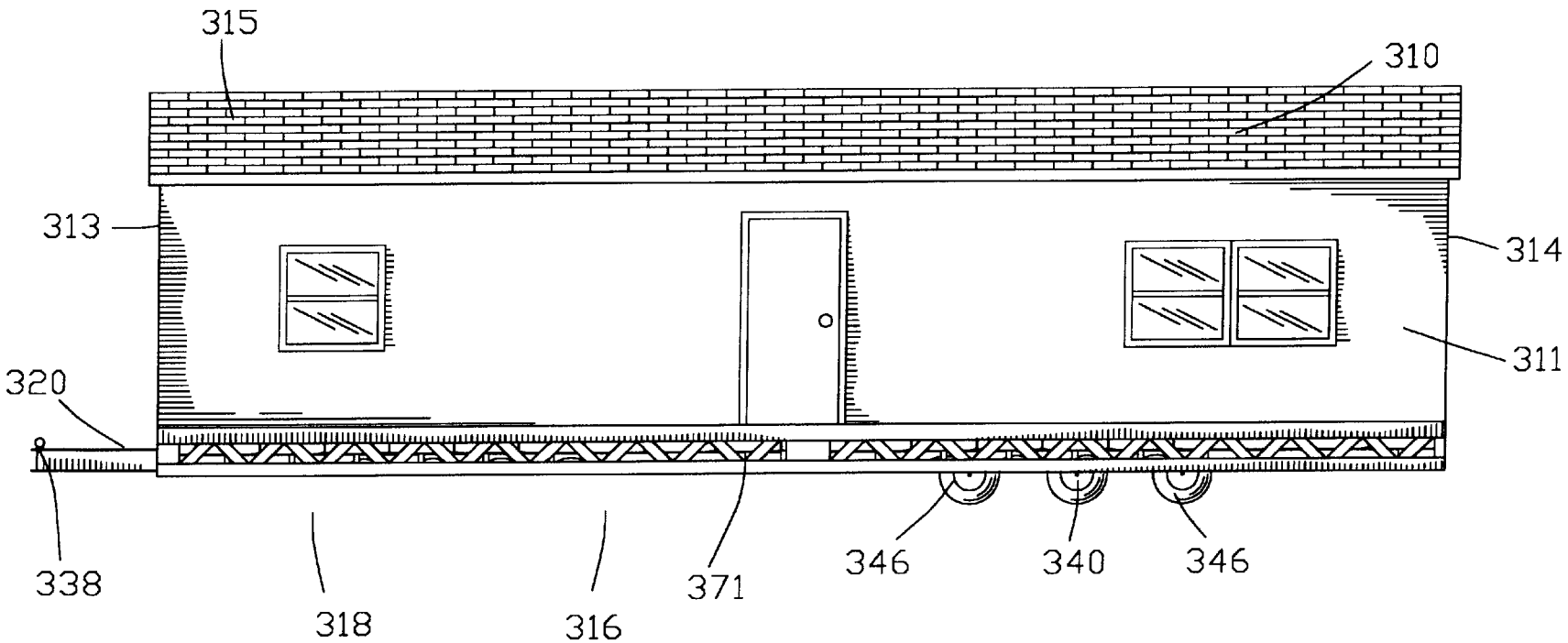
FIG. 15 is a side elevational view of FIG. 14.
Figure 16:
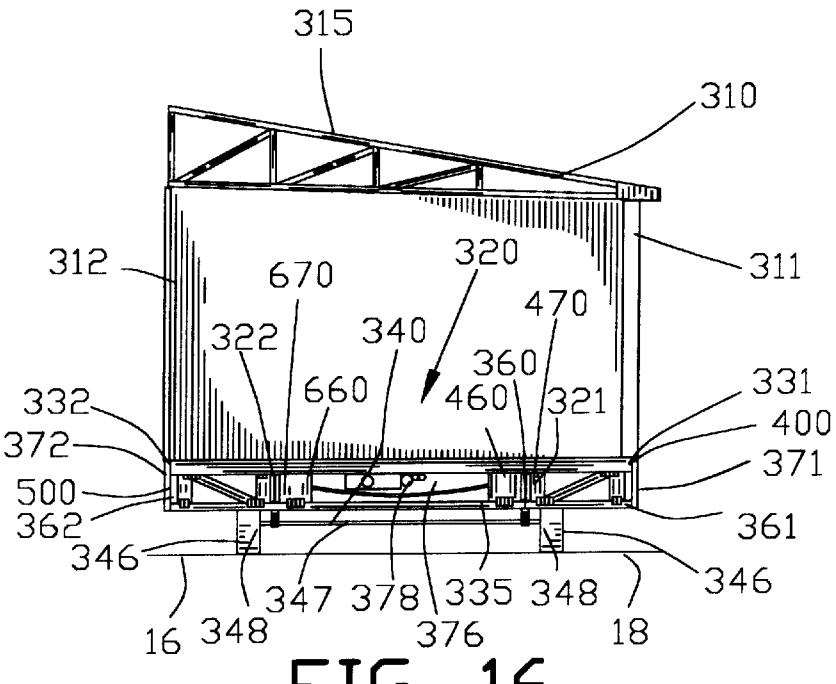
FIG. 16 is an end view of FIG. 15.

FIGS. 14–16 are isometric, side and end views of a second embodiment of a manufactured home 310. The manufactured home 310 comprises peripheral walls 311 and 312, end walls 313 and 314 and a roof 315. The manufactured home 310 is designed to be transported to a remote location and to be erected on a ground surface 16 at a building site 18.

As best shown in FIG. 16, the manufactured home 310 comprised a frame 320 having a first and a second longitudinally extending frame elements 321 and 322. Preferably, the frame elements 321 and 322 are steel I-beams separated by a plurality of struts 324. The frame 20 includes a plurality of upper transverse members shown as floor beams 330 extend in a spaced apart parallel relationship to the first and second longitudinally extending beams 321 and 322. Each of the plurality of floor beams 330 extends between a first and a second end 331 and 332. Preferably, each of the plurality of floor beams 330 is fashioned from wood.

A removable hitch 338 and a plurality of removable wheel assemblies 340 enable the manufactured home 310 to be towed to the building site 18. Each of the plurality of wheel assemblies 340 has plural wheels 346 journalled on an axle 347. The plurality of wheel assemblies 340 are secured to the frame elements 321 and 322 by springs 348. Upon reaching the building site 18, the removable hitch 330 and the plurality of removable wheel assemblies 340 are removed and the manufactured home 310 is permanently mounted at the building site 18.

Figure 17:
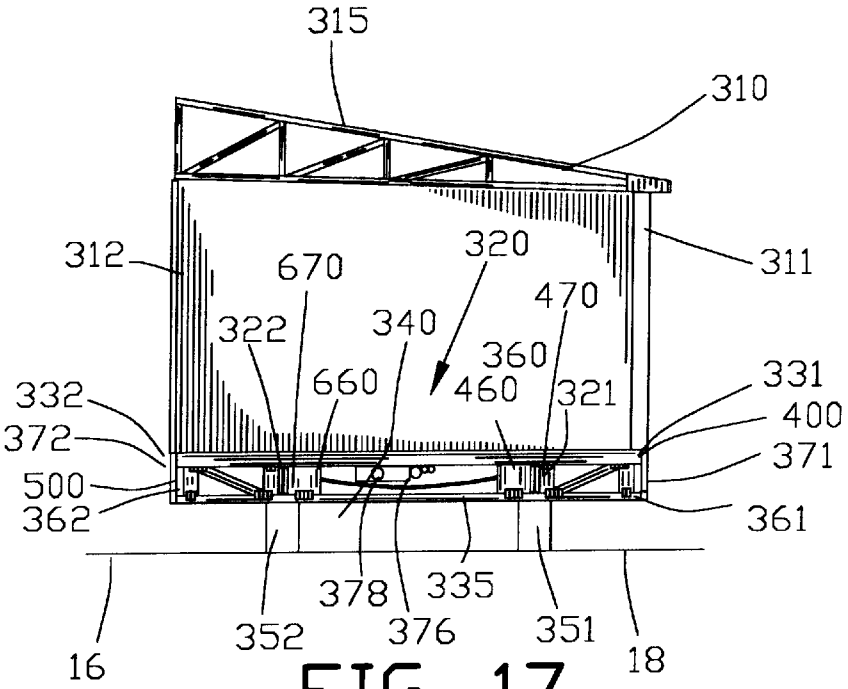
FIG. 17 is an end view of the manufactured home of FIG. 16 which has been placed upon a stem wall foundation.

FIG. 17 is an end view similar to FIG. 16 after the manufactured home 310 has been lifted and placed upon a foundation 350 comprising foundation pilings 351 and 352 on the ground surface 18. The manufactured home 310 is secured to the foundation pilings 351 and 352 by conventional means which should be well known to those skilled in the art. The foundation pilings 351 and 352 extend upwardly from the ground surface 16 to space the manufactured home 310 from the ground surface 16 as described heretofore.

Figure 18:
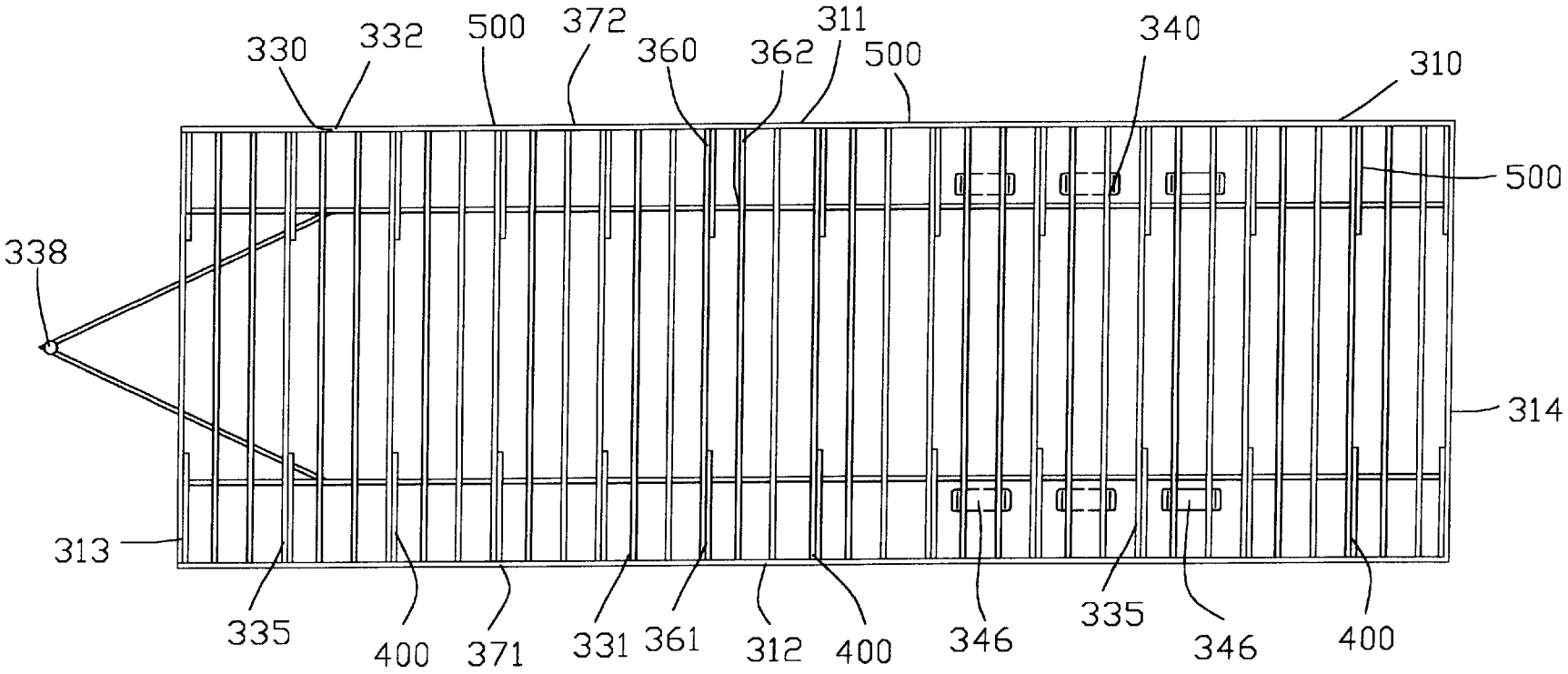
FIG. 18 is a top view of the frame of the manufactured home incorporating the second embodiment of the transverse truss of the present invention.

FIG. 18 is a top view of a floor frame of the manufactured home 310 of FIGS. 14–17. The manufactured home 310 is supported by the first and second I-beams 321 and 322. The hitch 338 is removably secured to the first and second I-beams 321 and 322. In a similar manner, the plurality of wheel assemblies 340 are removably secured to the first and second I-beams 321 and 322. Upon reaching the building site 18, the hitch 338 and the plurality of wheel assemblies 340 are removed from the first and second I-beams 321 and 322 and the manufactured home 310 is permanently mounted at the building site 18.

The frame 320 of the manufactured home 310 includes the first and second longitudinally extending beams 321 and 322 and the plurality of transverse floor beams 330. The first and second longitudinally extending beams 321 and 322 are shown as steel I-beams. The plurality of transverse floor beams 330 are disposed upon the first and second longitudinally extending beams 321 and 322. The plurality of transverse floor beams 30 support a floor or a roof structure as should be apparent to those skilled in the art.

The plurality of transverse trusses 335 extend perpendicularly to the first and second longitudinally extending beams 321 and 322. The plurality of transverse trusses 335 cooperate with selected ones of the plurality of floor beams 330 to add mechanical strength of the manufactured home 310. Each of the transverse trusses 335 comprises a lower transverse member 360 extending between a first end 361 and a second end 362. Preferably, the lower transverse member 360 is fashioned from wood. Each of the improved transverse trusses 335 comprises a first truss portion 400 and a second truss portion 500. The first and second truss portions 400 and 500 are respectively secured to the first and second ends 361 and 362 of the lower transverse member 360. The first and second truss portions 100 and 200 are mirror images of one another.

The improved transverse trusses 335 comprises a first and a second upstanding member 460 and 660 secured to the lower transverse member 360 adjacent to the first and second truss portions 400 and 500 for defining a first and a second slot 470 and 670 therebetween.

The first and second longitudinally extending beams 321 and 322 are received within the first and ssecond second slots 470 and 670. The first and second longitudinally extending beams 321 and 322 engage with the lower transverse member 360 and the first and second truss portions 400 and 500, respectively.

The first and second ends 331 and 332 of the floor beam 330 are respectively secured to the first and second truss portions 400 and 500. The first and second longitudinally extending beams 321 and 322 are enclosed within the first and second slots 470 and 670 by the floor beam 30. Preferably, a first and a second peripheral beam 71 and 72 are secured to the first and second ends 331 and 332 of the floor beam 330.

A void 376 is defined between the first and second upstanding members 460 and 660. The void 376 receives a service device 378 such as an air conduits, electrical wires and conduits and plumbing pipes and the like.

FIG. 18 is a top view of the frame 320 of the manufactured home 310 incorporating the first embodiment of the plurality of transverse truss 335 of the present invention. The manufactured home 10 includes the plurality of the transverse truss 335 cooperating with selected ones of the plurality of floor beams 330. In this embodiment of the invention, the plurality of transverse truss 335 cooperate with every third floor beams 330. However, it should be appreciated by those skills in the art that the spacing of the plurality of transverse trusses 335 may be varied in accordance with the desired load requirement of the floor or roof structure.

Figure 19:
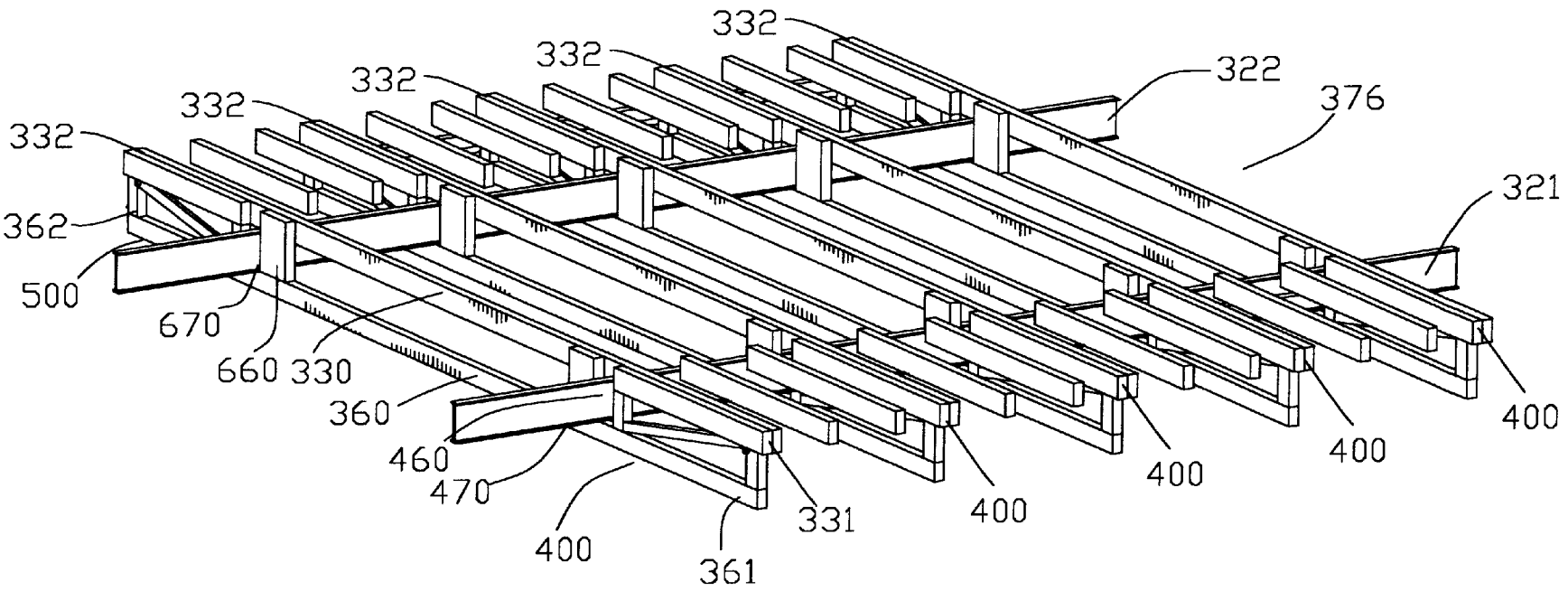
FIG. 19 is an enlarged isometric view of a forward portion of the frame of the manufactured home of FIG. 18.

FIG. 19 is an enlarged isometric view of a forward portion of the frame 320. In this example of the invention, the plurality of floor beams 330 are shown as wood beams. The plurality of floor beams 30 arranged in a substantially parallel relationship and are supported by the first and second longitudinally extending beams 321 and 322. Each of the improved transverse truss 335 comprises the first truss portion 400 and second truss portions 500.

Figure 20:
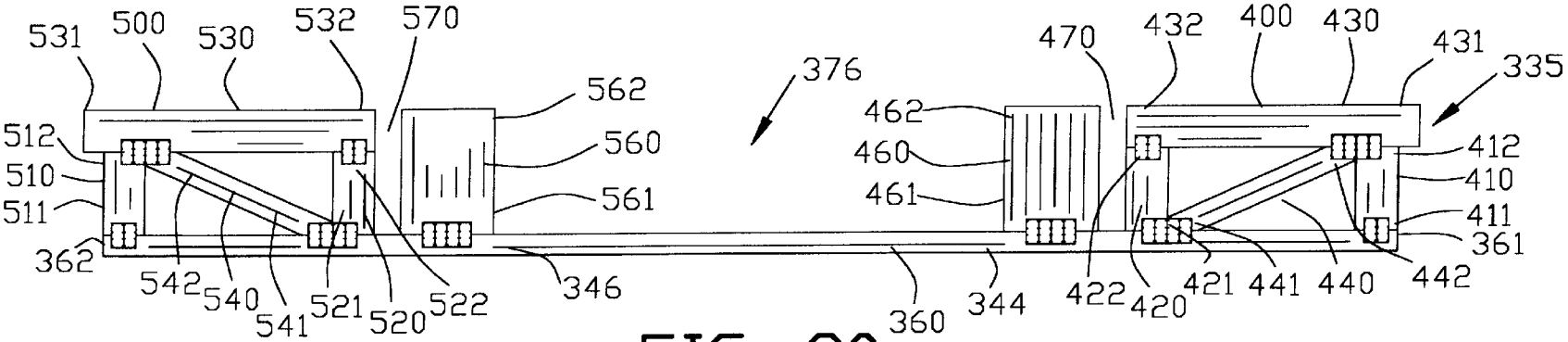
FIG. 20 is an enlarged view of a portion of FIG. 17 illustrating the second embodiment of the transverse truss of the present invention.

FIG. 20 is an enlarged front view of the transverse truss 336 of FIGS. 16–19. The transverse truss 335 comprises a lower transverse member 360 extending between the first end 361 and the second end 362. Preferably, the lower transverse member 360 is fashioned from wood. The first and second truss portions 400 and 500 are respectively secured to the first and second ends 361 and 362 of the lower transverse member 360.

The first truss portion 400 comprises an outer support 410 having a first and a second end 411 and 412. The first end 411 of the outer support 410 is secured in proximity to the first end 361 of the lower transverse member 360. The second end 412 of the outer support 410 extends upwardly from the lower transverse member 360. The outer support 410 extends substantially perpendicular to the lower transverse member 360. Preferably, the outer support 410 is fashioned from wood.

An inner support 420 extends between a first and a second end 421 and 422. The first end 421 of the inner support 420 is secured in proximity to an interior region 364 of the lower transverse member 60. The second end 422 of the inner support 420 extends upwardly from the lower transverse member 60. The inner support 420 extends substantially perpendicular to the lower transverse member 60. Preferably, the inner support 420 is fashioned from wood.

An upper truss element 430 extends between a first and a second end 431 and 432. The first end 431 of the upper truss element 430 is connected to the second end 412 of the outer support 410 whereas the second end 432 of the upper truss element 430 is connected to the second end 422 of the inner support 420. Preferably, the upper truss element 430 is fashioned from wood.

A brace 440 extends between a first end 441 and a second end 442. The brace 440 is angularly disposed between the outer support 410 and the inner support 420. In this embodiment of the invention, the first end 441 of the brace 440 is secured to the intersection of the lower transverse member 360 with the first end 421 of the inner support 420. The second end 442 of the brace 440 is secured to the intersection of the upper truss element 430 with the second end 422 of the outer support 410. Preferably, the brace 440 is fashioned from wood.

The outer support 410 and the inner support 420 are secured to the lower transverse member 360 by mechanical fasteners such as gang nails, metal plates and metal fasteners or the like. The outer support 410 and the inner support 420 are secured to the upper truss element 430 by mechanical fasteners such as gang nails, metal plates and metal fasteners or the like. Similarly the brace 440 is secured by mechanical fasteners such as gang nails, metal plates and metal fasteners or the like.

The second truss portion 500 comprises an outer support 510 having a first and a second end 511 and 512. The first end 511 of the outer support 510 is secured in proximity to the second end 362 of the lower transverse member 360. The second end 512 of the outer support 510 extends upwardly from the lower transverse member 360. The outer support 510 extends substantially perpendicular to the lower transverse member 360. Preferably, the outer support 510 is fashioned from wood.

An inner support 520 extends between a first and a second end 521 and 522. The first end 521 of the inner support 520 is secured in proximity to an interior region 366 of the lower transverse member 60. The second end 522 of the inner support 520 extends upwardly from the lower transverse member 360. The inner support 520 extends substantially perpendicular to the lower transverse member 360. Preferably, the inner support 520 is fashioned from wood.

An upper truss element 530 extends between a first and a second end 531 and 532. The first end 531 of the upper truss element 530 is connected to the second end 512 of the outer support 510 whereas the second end 532 of the upper truss element 530 is connected to the second end 522 of the inner support 520. Preferably, the upper truss element 530 is fashioned from wood.

A brace 540 extends between a first end 541 and a second end 542. The brace 540 is angularly disposed between the outer support 510 and the inner support 520. In this embodiment of the invention, the first end 541 of the brace 540 is secured to the intersection of the lower transverse member 60 with the first end 521 of the inner support 520. The second end 542 of the brace 540 is secured to the intersection of the upper truss element 530 with the second end 512 of the outer support 510. Preferably, the brace 540 is fashioned from wood.

The outer support 510 and the inner support 520 are secured to the lower transverse member 60 by mechanical fasteners such as gang nails, metal plates and metal fasteners or the like. The outer support 510 and the inner support 520 are secured to the upper truss element 530 by mechanical fasteners such as gang nails, metal plates and metal fasteners or the like. Similarly the brace 540 is secured by mechanical fasteners such as gang nails, metal plates and metal fasteners or the like.

Each of the improved transverse truss 335 comprises a first upstanding member 460 and a second upstanding member 560. The first upstanding member 460 extends between a first and a second end 461 and 462. The first end 461 of the first upstanding member 460 is secured to the lower transverse member 360 adjacent to the first truss portion 400 for defining a first slot 470 therebetween. The first upstanding member 460 extends perpendicularly from the lower transverse member 360 a distance commensurate with a distance the first truss portion 410 extends from the lower transverse member 360.

The second upstanding member 560 extends between a first and a second end 561 and 562. The first end 561 of the second upstanding member 560 is secured to the lower transverse member 360 adjacent to the second truss portion 500 for defining a second slot 570 therebetween. The second upstanding member 560 extends perpendicularly from the lower transverse member 360 a distance commensurate with a distance the second truss portion 500 extends from the lower transverse member 360.

The void 376 is defined between the first and second upstanding members 460 and 560. The void 376 receives a service device 378 such as an air conduits, electrical wires and conduits and plumbing pipes and the like. The void 376 shown in FIGS. 20 and 21 is an open top void 376 for facilitating the introduction of the service device 378 with the void 376.

Figure 21:
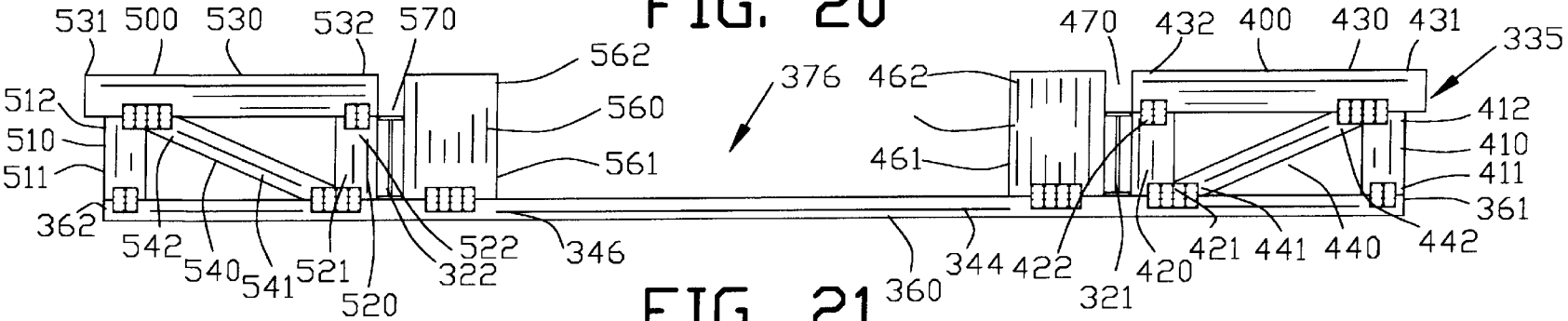
FIG. 21 is a view similar to FIG. 20 illustrating the second embodiment of the transverse truss receiving a first and a second longitudinally extending beam.

FIG. 21 illustrates the first and second longitudinally extending beams 321 and 322 being received within the first and second slots 470 and 570. The first longitudinally extending beam 321 engages with the lower transverse member 360, the inner support 410 and the upstanding member 460. Similarly, the second longitudinally extending beam 322 engages with the lower transverse member 360, the inner support 510 and the upstanding member 560.

Figure 22:
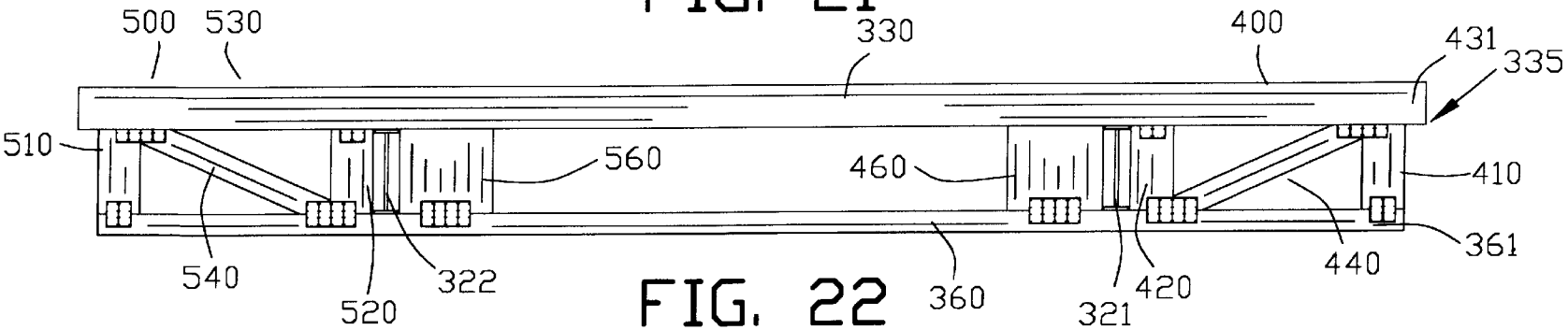
FIG. 22 is a view similar to FIG. 21 illustrating the securing of the first and second longitudinally extending beams within the transverse truss.
Figure 23:
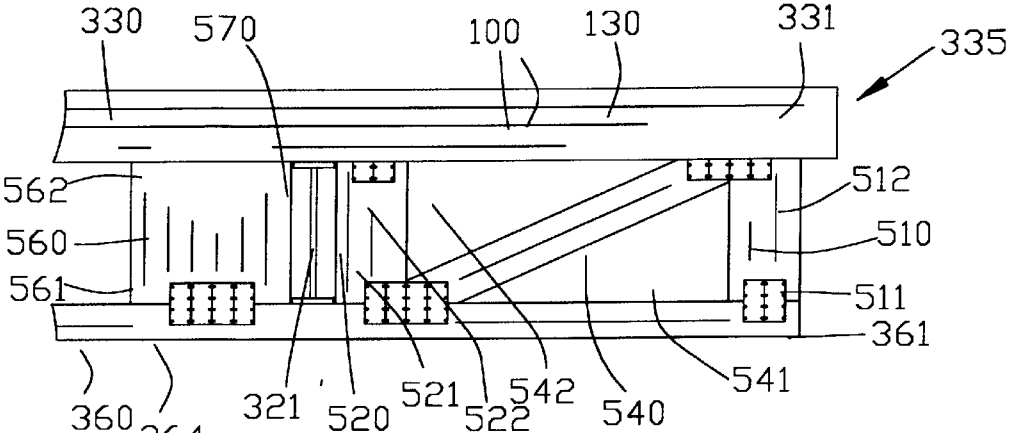
FIG. 23 is a magnified view of a portion of FIG. 22.
Figure 24:
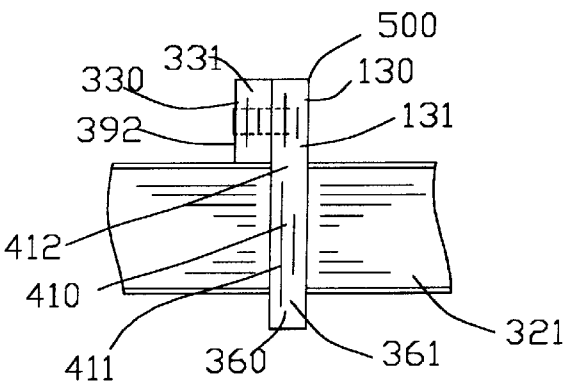
FIG. 24 is a right side view of FIG. 23.

FIG. 22 is a view similar to FIG. 21 illustrating the first and second ends 331 and 332 of the floor beam 330 being secured to the first and second truss portion 400 and 500. In addition, the floor beam 330 is secured to the first and second upstanding members 460 and 560. The floor beam 30 is secured by mechanical fasteners such as gang nails, metal plates and metal fasteners or the like.

Figure 25:
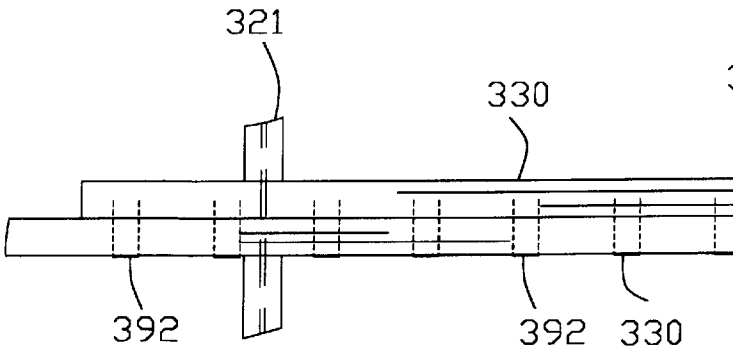
FIG. 25 is a top view of FIG. 23.
Figure 26:
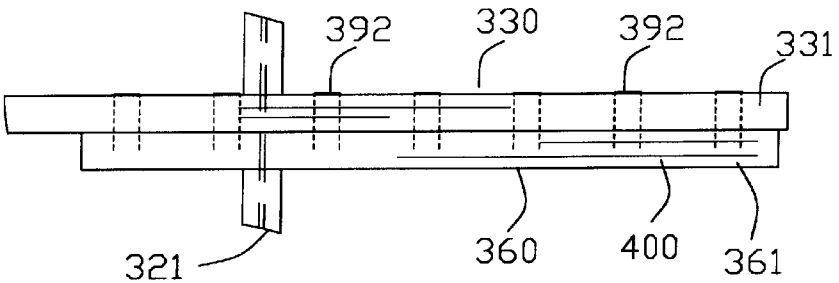
FIG. 26 is a bottom view of FIG. 23.

FIGS. 23–26 are various magnified views of a portion of FIG. 22. The floor beam 330 entraps the first and second longitudinally extending beams 321 and 322 within the first and second slots 470 and 570 of the transverse truss 335. As best shown in FIG. 25, a conventional brackets 390 may be provided for securing the first and second longitudinally extending beams 321 and 322 to the transverse truss 335 in proximity to the first and second slots 470 and 570. Preferably, the first and second ends 331 and 332 of the floor beam 330 are secured to the first and second truss portions 400 and 500 by suitable means such as an adhesive, mechanical fasteners such as nails or staples 392 or a combination of both. The first and second ends 331 and 332 of the floor beam 330 may be secured to the first and second truss portions 400 and 500 by an adhesive with staples 392 holding the floor beam 330 during the curing of the adhesive.

Each of the peripheral beams 171 and 172 comprises an upper horizontal beam 174, a lower horizontal beam 175. A plurality of vertical beams 176 vertically space the upper horizontal beam 174 relative to the lower horizontal beam 175. A plurality of diagonal beams 178 interconnect the upper horizontal beam 174 to the lower horizontal beam 175. The beams 174–178 are arranged in the form of a truss to provide strength to the present invention.

Figure 27:
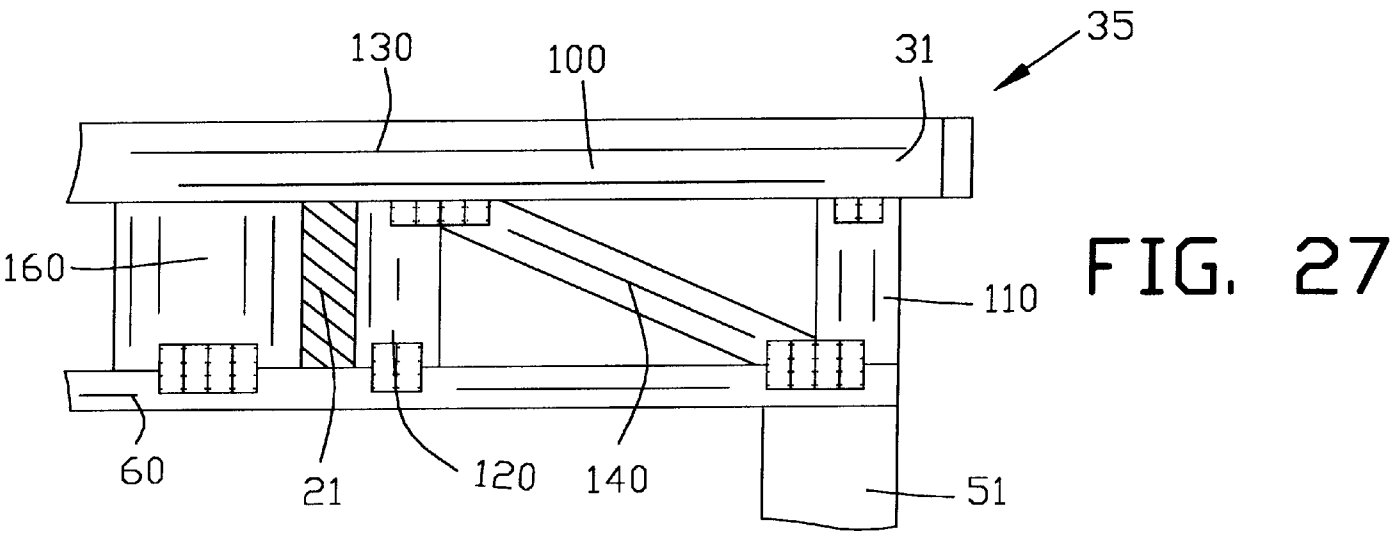
FIG. 27 is a magnified view of a portion of FIG. 4 illustrating the forces applied to the first embodiment of the improved transverse truss of the present invention.

FIG. 27 is a magnified view of a portion of FIG. 4 illustrating the vector forces applied to the first embodiment of the first truss portion 100. The manufactured home 10 of FIG. 27 is supported by the first peripheral beam 71 resting upon the foundation piling 51. However, it should be appreciated that the manufactured home 10 may be supported by the first 21 resting upon the foundation pilings 51 in a manner similar to FIG. 28.

The force of the wall and roof is applied from the wall 11 through the first truss portion 100 to the foundation pilings 351. The force of the first beam 21 is applied through the first brace 140 to the outer member 110. The brace 140 supports the first beam 21 through a tension force applied to the brace 140.

Figure 28:
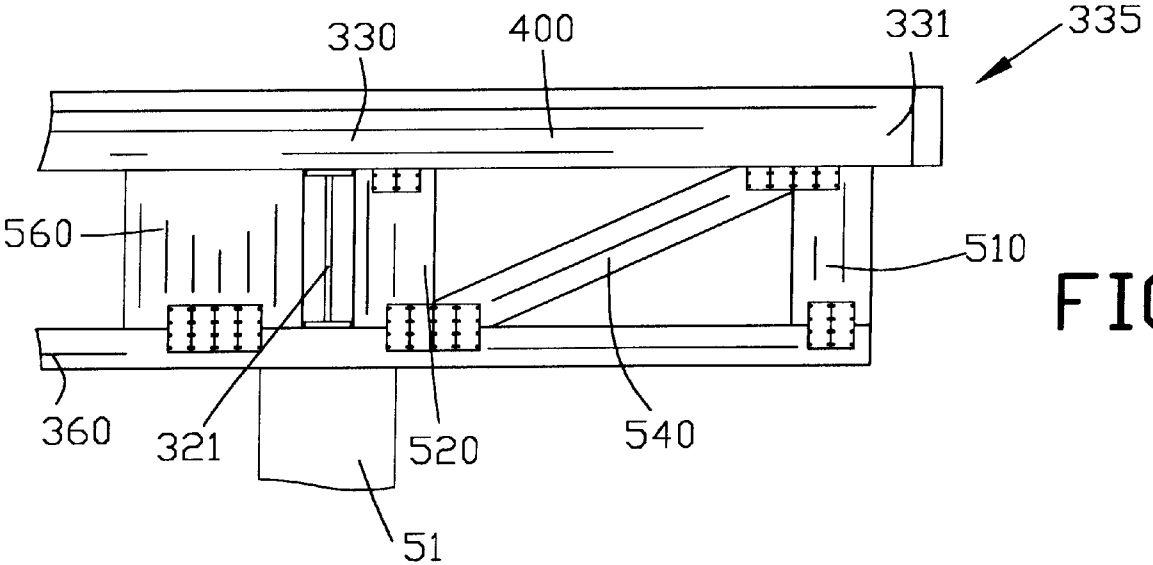
FIG. 28 is a magnified view of a portion of FIG. 17 illustrating the forces applied to the second embodiment of the improved transverse truss of the present invention.

FIG. 28 is a magnified view of a portion of FIG. 17 illustrating the vector forces applied to the second embodiment of the first truss portion 400. The manufactured home 310 of FIG. 28 is supported by the I-beam 321 resting upon the foundation pilings 51. The force of the wall and roof is applied from the wall 311 to the first end 361 of the transverse beam 360. The force of the first end 361 of the transverse beam 360 is applied through the brace 440 to the foundation pilings 51. The brace 440 supports the second end 412 of the outer member 410 from the foundation pilings 51 through a compressive force applied to the brace 440.

In the first embodiment of the invention, the first end 141 of the brave 140 is secured to the intersection of the lower transverse member 60 and the first end 111 of the outer support 110 and the second end 142 of the brace 140 is secured to the intersection of the upper truss element 130 with the second end 122 of the inner support 120. This brace construction may be desirable for transporting the building structure through the use of the carrier 36. Furthermore, the use of the first and second longitudinally extending beams 21 and 22 made of wood is suitable for transportation on a carrier 36.

In the second embodiment of the invention, the first end 441 of the brace 440 is secured to the intersection of the lower transverse member 360 and the first end 421 of the inner support 420 and the second end 442 of the brace 440 is secured to the intersection of the upper truss element 430 with the second end 412 of the outer support 410. This brace construction may be desirable for transporting the building structure with an integral frame without the use of a separate carrier 36. Furthermore, the use of the first and second longitudinally extending beams 21 and 22 made of steel I-beams is suitable for transportation without a carrier 36.

Figure 30:
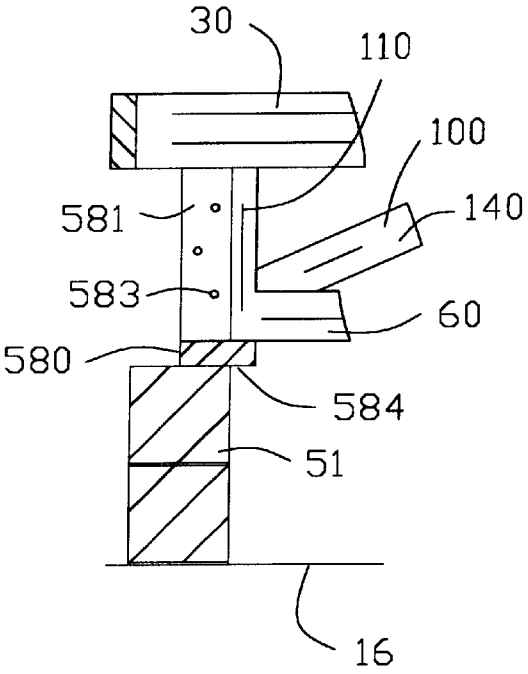
FIG. 30 is a sectional view along line 30—30 in FIG. 29.
Figure 29:
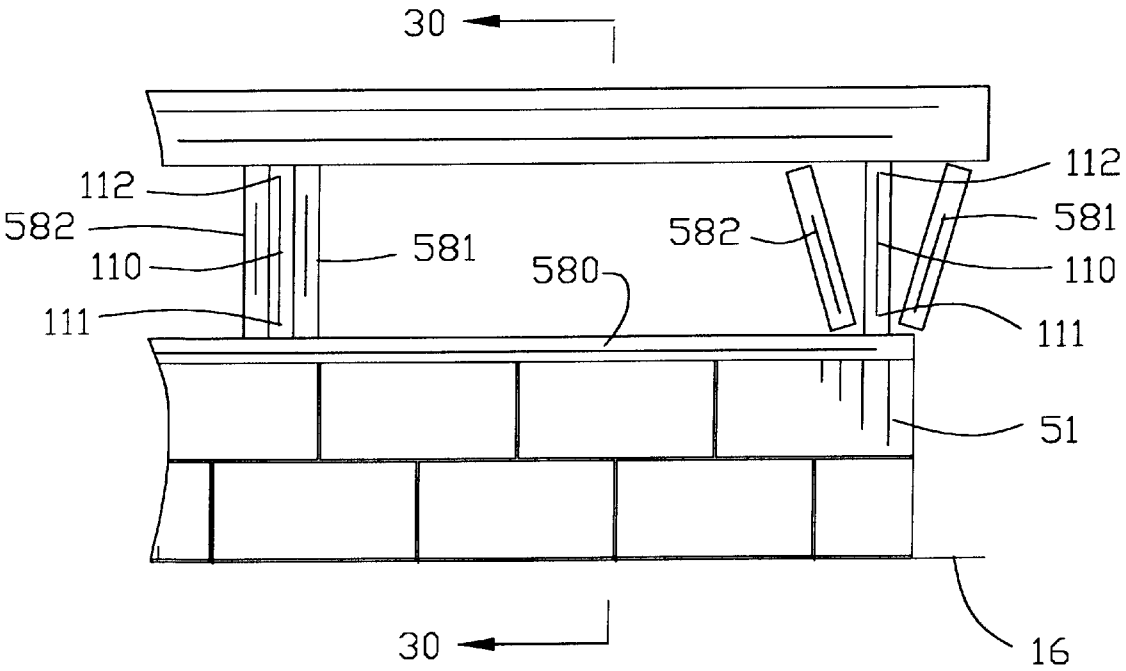
FIG. 29 is a magnified side view of a portion of FIG. 2 illustrating a first example of an alternate method of supporting the manufactured home.

FIGS. 29 and 30 are magnified side and sectional views of a portion of FIG. 2 illustrating a first example of an alternate method of supporting the manufactured home 10. In this example, the foundation piling 51 supports a sill plate 580. The lower transverse member 60 rests on the sill plate 580. Plural support members of 581 and 580 are positioned on opposed sides of the outer support 110. The plural support members 581 and 580 are secured to the outer support 110 by mechanical fasteners 583. Preferably, the mechanical fasteners 583 are bolts or screws. A screw 584 extends through the sill plate 580 to extend into the lower transverse member 60. The transverse truss 110 of the present invention enables the frame 20 to be readily directly connected to the foundation piling 51.

Figure 32:
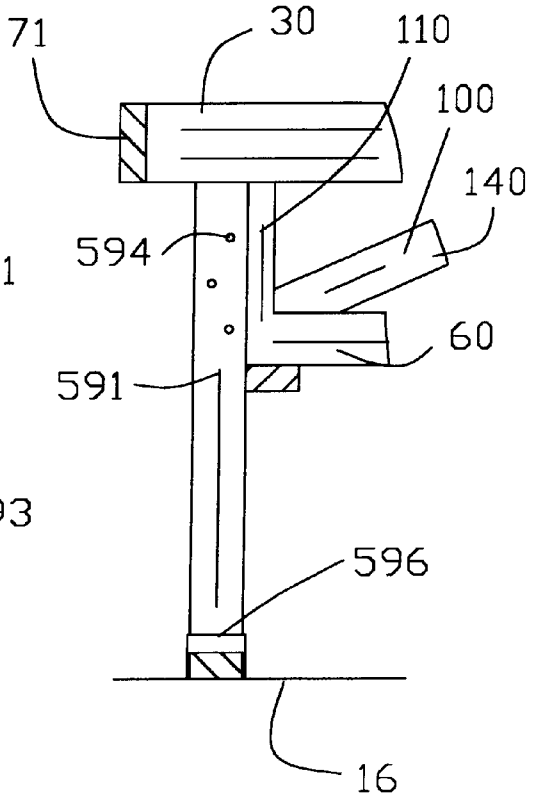
FIG. 32 is a sectional view along line 32—32 in FIG. 31.
Figure 31:
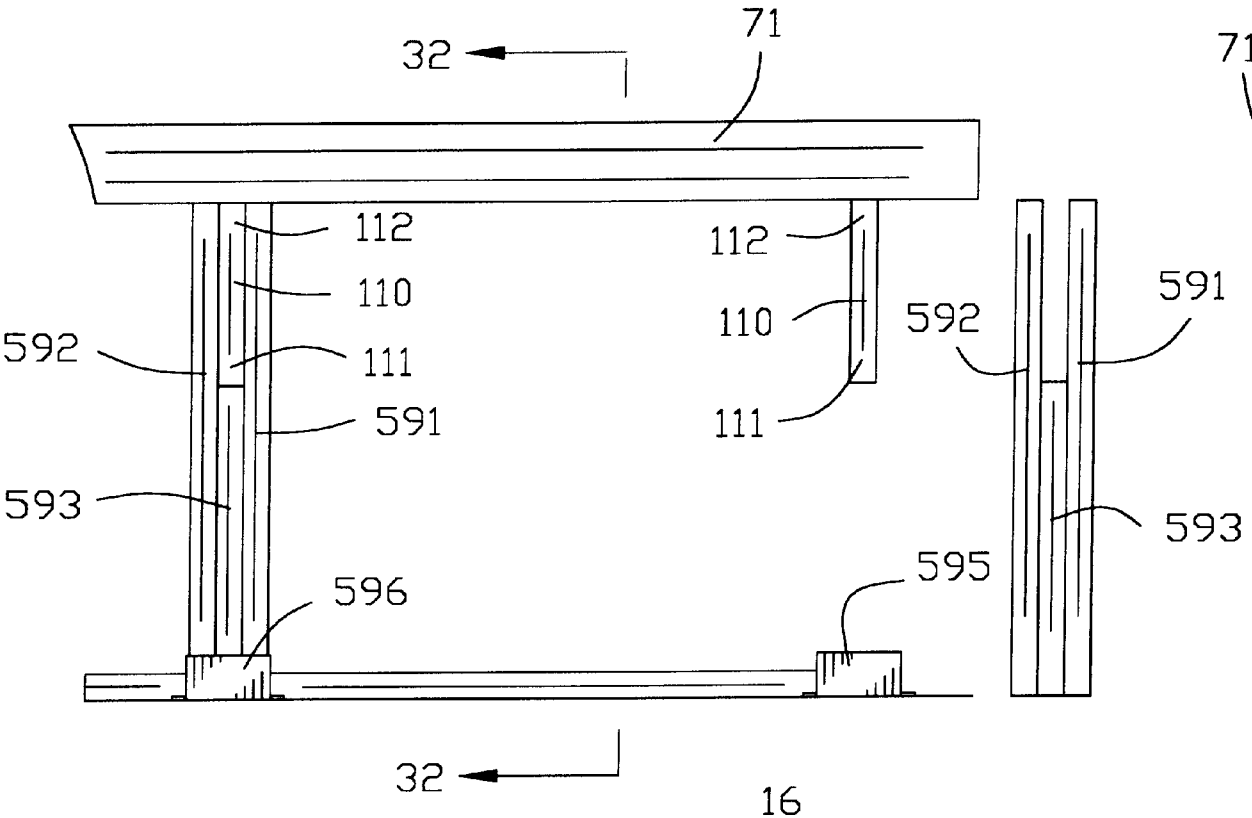
FIG. 31 is a magnified side view of a portion of FIG. 2 illustrating a second example of an alternate method of supporting the manufactured home.

FIGS. 31 and 32 are magnified side and sectional views of a portion of FIG. 2 illustrating a second example of an alternate method of supporting the manufactured home 10. In this example of the invention, plural support members 591 and 592 are interconnected by an intermediate support member 593 to form an assembly of the support members 591–593. The assembly of the support members 591–593 may be interconnected by adhesive or mechanical fastening means. The assembly of the support members 591–593 are positioned on opposed sides of the outer support 110 with the bottom of the lower transverse member 60 resting on the intermediate support member 593. Preferably, the lower portion of the assembly of support members 591–593 is position within a mechanical fastener 595. The examples shown in the FIGS. 29–32 illustrate the versatility of the present invention wherein the frame 20 may be secured either to a foundation piling 51 or to a ground surface 16 by the mechanical fastener 595.

Figure 34:
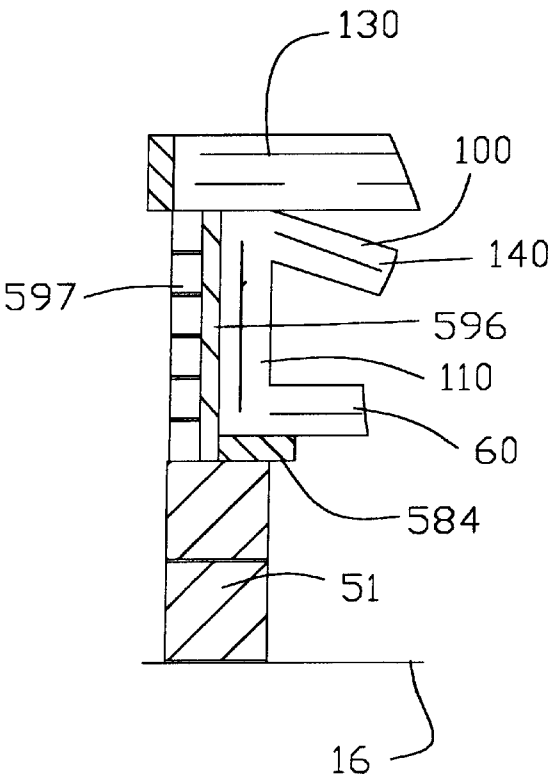
FIG. 34 is a sectional view along line 34—34 in FIG. 33.
Figure 33:
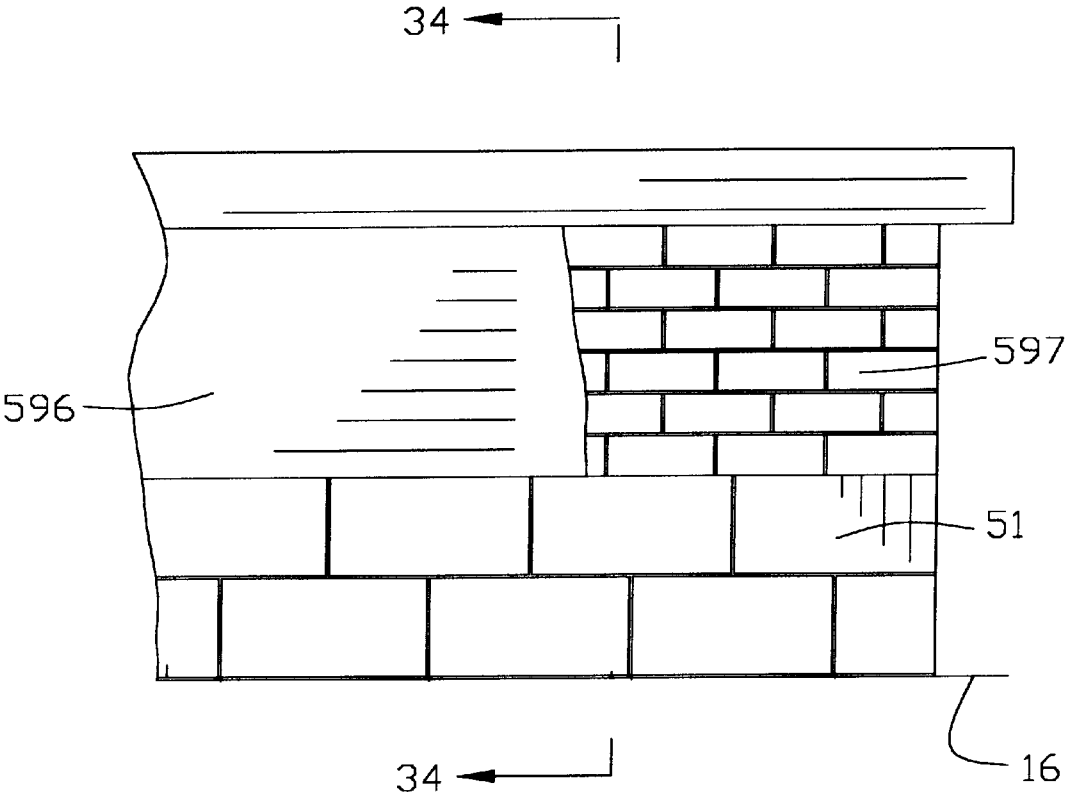
FIG. 33 is a magnified side view of a portion of FIG. 2 illustrating a first example of a covering material for the lower portion of the manufactured home.

FIGS. 33 and 34 are magnified side and sectional views of a portion of FIG. 2 illustrating a first example of a covering material for the lower portion of the manufactured home 10. In this example of the invention, a sheet material 596 is secured to outer member 110. Thereafter, a masonry material shown as bricks 597 may be built upon the foundation piling 51 to extend to the floor beam 30. The use of masonry material 597 between the foundation piling 51 and the floor beams 30 present the appearance of a site built home.

Figure 36:
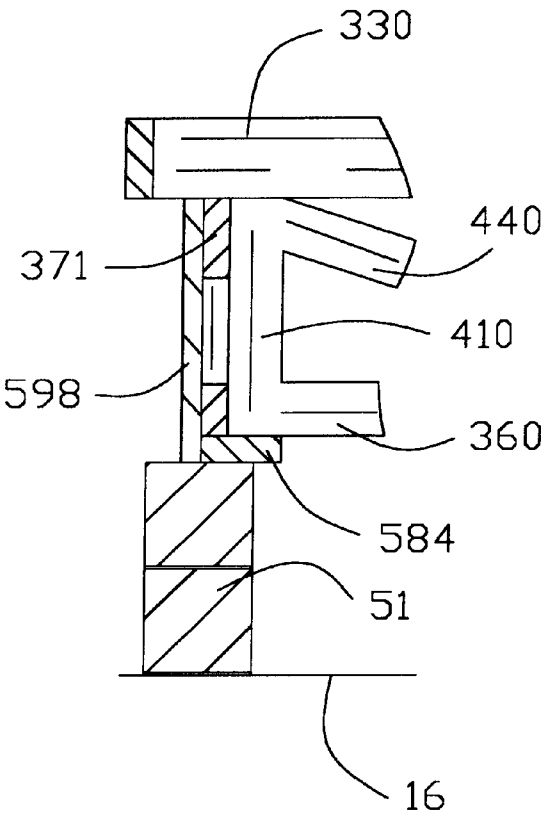
FIG. 36 is a sectional view along line 36—36 in FIG. 35.
Figure 35:
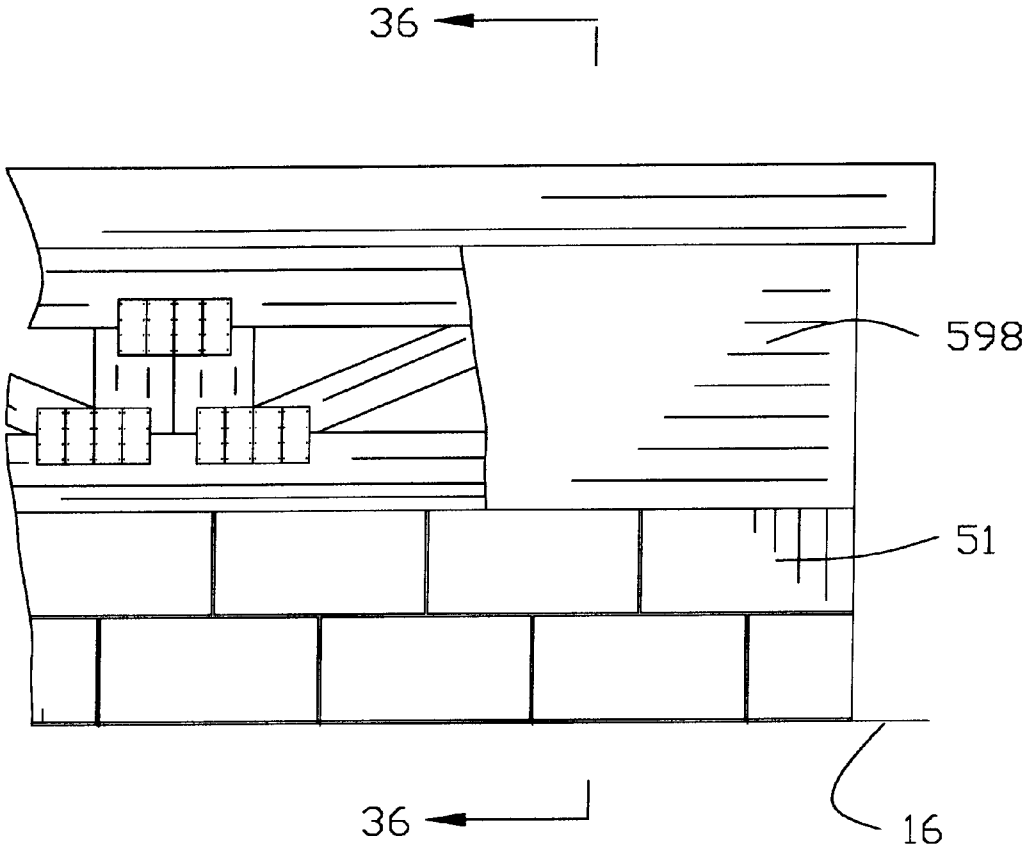
FIG. 35 is a magnified side view of a portion of FIG. 15 illustrating a second example of a covering material for the lower portion of the manufactured home.

FIGS. 35 and 36 are magnified side and sectional views of a portion of FIG. 15 illustrating a second example of a covering material for the lower portion of the manufactured home. In this embodiment of the invention, a sheet material and 598 is applied to the peripheral beam 371. Thereafter, the sheet material 598 may be painted, or finished in a way suitable for the building owner.

Figure 37:
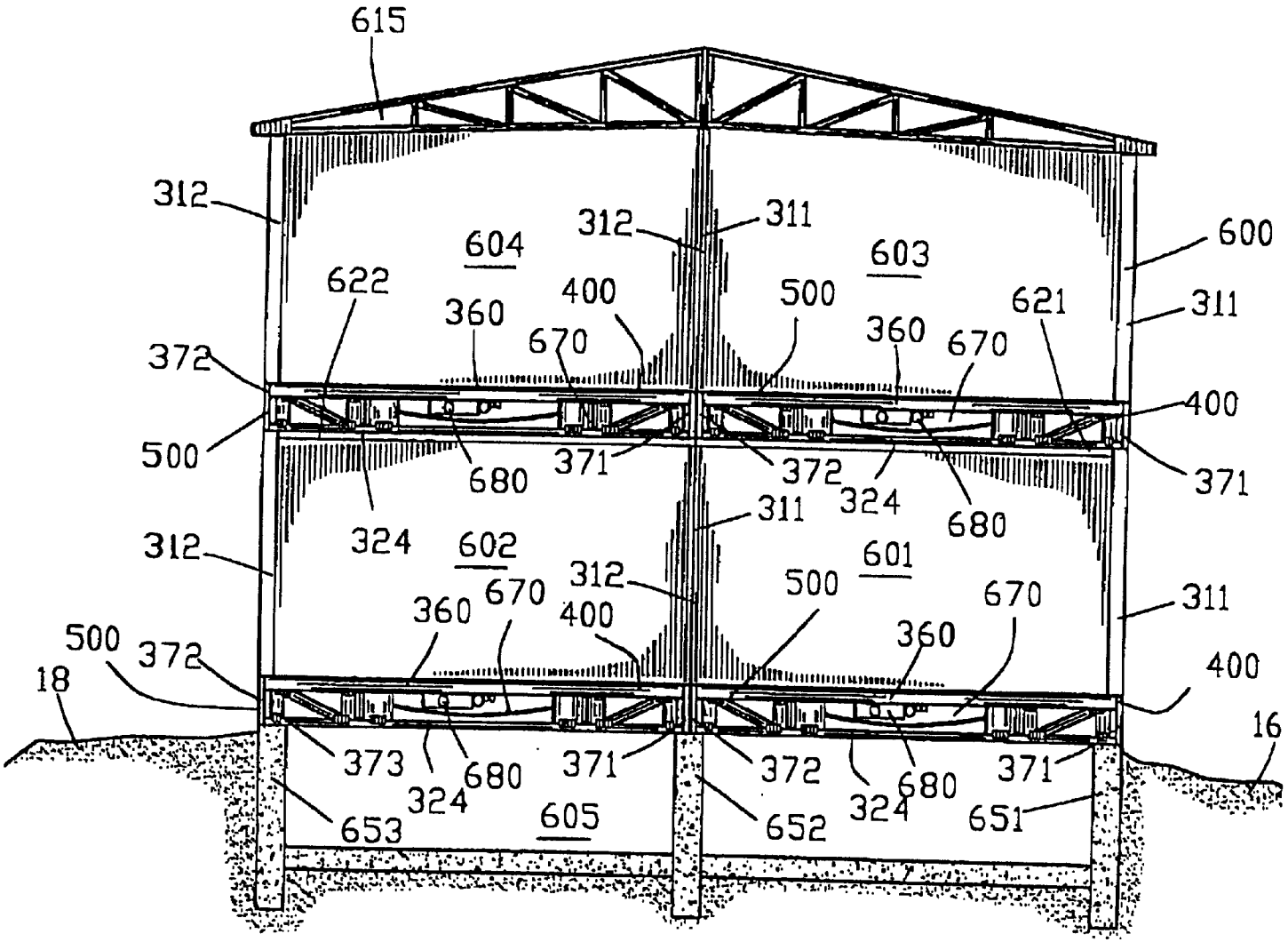
FIG. 37 is an end view of multiple components of a manufactured home incorporating the present invention and disposed upon a foundation.

FIG. 37 is an end view of a multiple story manufactured home 600 built in accordance with the present invention. The multiple story manufactured home 600 comprises four units 601–604 with units 601 and 602 comprising the first floor and with units 603 and 604 comprising the second floor. First floor unit 601 is a mirror of first floor unit 602 whereas second floor unit 603 is a mirror of the second floor unit 604.

The first floor units 601 and 602 may include roof beams 621 and 622 extending between the first and second sidewalls 311 and 312 for establishing and maintaining the position of the upper portions of the sidewalls 311 and 312 of each of the first floor units 601 and 602. Each of the first floor units 601 and 602 include a multiplicity of transverse beams 360 and a first and a second peripheral beam 371 and 372 as heretofore described.

In this embodiment, the foundation is shown as foundation walls 651–653 disposed about a basement. The center foundation wall 652 may be a foundation wall as shown or may be a beam extending across the span of the basement 605 as should be well known to those skilled in the art.

The first floor units 601 and 602 are positioned on the foundation walls 651–653 and are shown with the first floor units 601 and 602 being joined by conventional means as should be well known to those skilled in the art.

Each of the second floor units 603 and 604 comprise of the multiplicity of transverse beams 360 and peripheral beams 371 and 372. The second floor units 603 and 604 are positioned such that the peripheral beams 371 and 372 of the upper unit 603 are positioned directly upon the sidewalls 311 and 312 of the first floor unit 601. In a similar manner, the peripheral beams 371 and 372 of the second floor unit 604 are positioned directly above the sidewalls 311 and 312 of the first floor unit 602. Accordingly, the second floor units 603 and 604 are supported by the foundation 651–653 through the compression of sidewalls 311 and 312 of the first floor units 601 and 602.

Voids 670 are defined between the multiplicity of transverse beams 360 and the plurality of struts 324 of each of the units 601–604 for accommodating and receiving pipes, electrical conduits, air ducts 680 or the like. The pipes, electrical conduits, air ducts 680 are suspended by the multiplicity of transverse beams 360. The first and second truss portions 400 and 500 inhibit the downward deflection of the multiplicity of transverse beams 360 by the weight of the first and second I-beams 321 and 322 as well as the weight of the pipes, electrical conduits, air ducts 680 added to the normal floor load of the manufactured home 310.

A significant advantage of the present invention is the ability to customize a manufactured home 10 in accordance with a desired roof load. As shown in FIGS. 5, the first and second truss portions 100 and 200 are spaced within the multiplicity of floor beams 30. In the example shown in FIG. 5, the multiplicity of floor beams 30 are spaced on 16 inch centers. The first and second truss portions 100 and 200 are spaced on 48 inch centers. The present invention enables a manufacturer to space the first and second truss portions 100 and 200 in a spacing to correspond to a desired roof load of the manufactured home 10.

The use of the first and second truss portions 100 and 200 enable a manufacturer of the manufactured home 10 to quickly and easily modify the manufactured home 10 during the construction process to comply with the building requirements of different regions of the country.

For example, a region of the country subjected to heavy snowfall will require the manufactured home 10 to have a higher roof load requirement then a region of the country which is subjected only to light rain. The present invention enables a manufacturer of the manufactured home to use a common construction plan for both regions of the country while adapting the construction plan affixing an appropriate number of the first and second truss portions 100 and 200 to comply with the building requirements of the region of the country with the high snowfall.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An improved transverse truss for a building structure, the transverse truss adapted to cooperate with a first and a second longitudinally extending beam of the building structure, comprising:

a lower transverse member extending between a first and a second end;

a first and a second truss portion secured to said first and second ends of said lower transverse member;

a first and a second upstanding member secured to said lower transverse member adjacent to said first and second truss portions defining a first and a second slot therebetween;

said first and said second slots being defined for receiving the first and the second longitudinally extending beam, respectively;

an upper transverse member extending between a first and a second end; and said first and second ends of said upper transverse member being secured to said first and second truss portions for entrapping the first and second longitudinally extending beams within said first and second slots.

2. An improved transverse truss for a building structure as set forth in claim 1, wherein the first and second longitudinally extending beams of the building structure are wooden beams.

3. An improved transverse truss for a building structure as set forth in claim 1, wherein the first and second longitudinally extending beams of the building structure are wooden beams having a substantially rectangular cross-section.

4. An improved transverse truss for a building structure as set forth in claim 1, wherein the first and second longitudinally extending beams of the building structure are steel beams.

5. An improved transverse truss for a building structure as set forth in claim 1, wherein the first and second longitudinally extending beams of the building structure are steel I-beams.

6. An improved transverse truss for a building structure as set forth in claim 1, wherein said lower transverse member extends in a substantially horizontal direction.

7. An improved transverse truss for a building structure as set forth in claim 1, wherein said lower transverse member is adopted to be disposed below the first and second longitudinally extending beams of the building structure.

8. An improved transverse truss for a building structure as set forth in claim 1, wherein each of said first and second truss portions comprises;

an outer support extending substantially perpendicularly to said lower transverse member;

an inner support extending substantially perpendicularly to said lower transverse member;

an upper truss element interconnecting said inner and outer supports; and a brace extending angularly between said inner and outer supports.

9. An improved transverse truss for a building structure as set forth in claim 1, wherein each of said first and second truss portions comprises;

an outer support extending substantially perpendicularly to said lower transverse member;

an inner support extending substantially perpendicularly to said lower transverse member;

an upper truss element interconnecting said inner and outer upright supports; and a brace extending angularly from an intersection between said lower transverse member and said outer upright member to an intersection between said upper truss element and said inner upright support.

10. An improved transverse truss for a building structure as set forth in claim 1, wherein each of said first and second truss portions comprises;

an outer support extending substantially perpendicularly to said lower transverse member;

an inner support extending substantially perpendicularly to said lower transverse member;

an upper truss element interconnecting said inner and outer upright supports; and a brace extending angularly from an intersection between said upper transverse member and said outer upright member to an intersection between said lower truss element and said inner upright support.

11. An improved transverse truss for a building structure as set forth in claim 1, wherein each of said first and second upstanding members extends generally perpendicular to said lower transverse member.

12. An improved transverse truss for a building structure as set forth in claim 1, wherein each of said upstanding members extends perpendicularly from said lower transverse member a distance commensurate with a distance said first and second truss portions extend from said lower transverse member.

13. An improved transverse truss for a building structure as set forth in claim 1, wherein said first and second upstanding members define a void between said first and second upstanding members for receiving a service device.

14. An improved transverse truss for a building structure as set forth in claim 1, including a first and a second bracket for securing the first and second longitudinally extending beams to said transverse truss in proximity to said first and second slots.

* * * * *